US005563691A

United States Patent [19]

Hayakawa et al.

[11] Patent Number: 5,563,691

[45] Date of Patent: Oct. 8, 1996

[54] IMAGE-FORMING APPARATUS

[75] Inventors: Takashi Hayakawa, Kyoto; Katsumi Adachi, Nara; Yuhi Yui, Nabari, all of Japan

[73] Assignee: Sharp Kabushiki Kaisha, Osaka, Japan

[21] Appl. No.: 463,774

[22] Filed: Jun. 5, 1995

[30] Foreign Application Priority Data

Jul. 6, 1994 [JP] Japan ..... 6-154749

[51] Int. Cl.[6] ..... G03G 21/00

[52] U.S. Cl. ..... 355/269; 355/219; 355/297

[58] Field of Search ..... 355/269, 297, 355/296, 299, 215, 219; 361/225

[56] References Cited

FOREIGN PATENT DOCUMENTS 55-100585 7/1980 Japan .
60-107678 6/1985 Japan .
62-203182 7/1987 Japan .

*Primary Examiner*—Joan H. Pendegrass
*Assistant Examiner*—Quana Grainger

[57] ABSTRACT

An image-forming apparatus including a cleaning means for selectively removing foreign matters other than developer remaining on the surface of a photoconductor drum therefrom after a transferring process. The cleaning means is provided with a foreign-matter removing roller which comes into contact with the surface of the photoconductor drum. Foreign matters, which are charged by a transferring device to have a polarity reversed to that of the charged electric potential of toner through an electric field that is exerted between the surfaces of the roller and the photoconductor drum, are allowed to adhere to the surface of the foreign-matter removing roller. As for the surface of the foreign-matter removing roller, the surface electric potential of the foreign-matter removing roller is biased farther toward the polarity of the charged toner than the surface electric potential of the photoconductor drum at the contact portion between the photoconductor drum and the foreign-matter removing roller. Thus, it becomes possible to provide an image forming apparatus which is capable of supplying images with good picture quality for a long time, by using a cleaning operation of this cleaning means.

24 Claims, 12 Drawing Sheets

IMAGE-FORMING APPARATUS

FIELD OF THE INVENTION

The present invention relates to an image-forming apparatus, such as an electrophotographic printing machine and a laser beam printer, which forms images by using the electrostatic photographic method.

BACKGROUND OF THE INVENTION

Generally, in an image-forming apparatus for forming images by using the electrostatic photographic method, an electrostatic latent image, which is formed on the surface of an image-bearing device such as a photoconductor drum, is developed by developer (hereinafter, referred to as toner), and this toner image is transferred onto a copy material such as a sheet of copy paper, thereby producing a copied image. In this system, in order to obtain copied images with good quality, it is essential to remove residual toner as well as foreign matters from the surface of the image-bearing device sufficiently. These foreign matters include paper particles, talc and kaolin derived from sheets of copy paper. For this reason, in order to remove residual toner as well as these foreign matters, there have been proposed various cleaning devices which are provided with a fur brush, a cleaning blade, a cleaning web, and other members, and which allow these cleaning blade and other members to come into contact with the surface of the image-bearing device.

However, these cleaning devices only have an arrangement wherein residual toner is scraped off from the surface of the image-bearing device by pressing the cleaning blade and other members onto the surface of the image-bearing device. In this arrangement, the cleaning device tends to cause scratches on the surface of the image-bearing device. Therefore, the cleaning device tends to shorten the life of the image-bearing device and cause adverse effects on the picture quality of copied images. Further, although the cleaning device is inexpensive, it fails to sufficiently remove the above-mentioned foreign matters that are likely to scatter. Moreover, it is necessary to install a waste-toner collecting container for storing residual toner removed by the cleaning device; this make it difficult to achieve a compact image-forming apparatus.

In order to solve the above-mentioned problems, various proposals have been made. For example, Japanese Laid-Open Patent Publication No. 100585/1980 (Tokukaishou 55-100585) discloses a cleaning device which is provided with a sponge-like porous elastic member.

Moreover, for example, Japanese Laid-Open Patent Publication No. 107678/1985 (Tokukaishou 60-107678) discloses a cleaning device which is provided with an insulating member. This cleaning device has an arrangement wherein the surface electric potential of the insulating member is set to be higher than the surface electric potential of the image-bearing device so that residual toner is removed by the use of electrostatic force. More specifically, as shown in FIG. 14, the image-bearing device (not shown) has its surface charged to a predetermined negative electric potential $V_{SP'}$ by a main charger, and is allowed to have an electrostatic latent image on its surface. Next, this electrostatic latent image is developed by toner that has been positively charged, and is transferred onto a copy material. Then, after the transferring process, the residual toner is kept at a positively charged state. Here, a negative electric potential $V_{CL'}$, which has an absolute value greater than that of the charged electric potential $V_{SP'}$ of the image-bearing device, is applied to the insulating member. Consequently, the residual toner, which has been positively charged, is affected by an electric field e' that has been formed by the image-bearing device and the insulating member, and is separated from the surface of the image-bearing device to adhere to the insulating member. Thus, the insulating member, that is, the cleaning device, removes the residual toner.

Moreover, for example, Japanese Laid-Open Patent Publication No. 142373/1983 (Tokukaishou 58-142373) and Japanese Laid-Open Patent Publication No. 261379/1988 (Tokukaishou 63-261379) disclose cleaning devices each of which is provided with a cleaning member and a contacting member that comes into contact with the cleaning member. These cleaning devices have an arrangement wherein the cleaning member is charged to have a electric potential whose polarity is reversed to that of the toner electric potential by friction between the cleaning member and the contacting member and an electrostatic force thus exerted is used for removing the residual toner and the foreign matters.

However, in the cleaning device disclosed by Japanese Laid-Open Patent Publication No. 100585/1980 (Tokukaishou 55-100585), the sponge-like porous elastic member is pressed onto the surface of the image-bearing device so that the residual toner is scraped off from the surface of the image-bearing device. For this reason, it is impossible to avoid the above-mentioned problems.

Further, in the cleaning device disclosed by Japanese Laid-Open Patent Publication No. 107678/1985 (Tokukaishou 60-107678), the following problems are raised when it is used in an image-forming apparatus wherein the positive developing method is adopted. For example, when amorphous selenium or other materials is used to constitute the image-bearing device, the image-bearing device is positively charged, while the toner is negatively charged, so as to form a toner image. For this reason, when the surface electric potential of the insulating member is made to become higher than the surface electric potential of the image-bearing device, the residual toner tends to adhere to the insulating member. Therefore, in order to store the residual toner removed by the insulating member into the waste-toner collecting container, a cleaning member for scraping the residual toner off from the insulating member has to be installed in a separated manner. Moreover, in the cleaning device, a cleaning blade is used together with the insulating member combinedly. Consequently the cleaning device fails to overcome the above-mentioned problems.

Furthermore, in the cleaning devices disclosed by Japanese Laid-Open Patent Publication No. 142373/1983 (Tokukaishou 58-142373) and Japanese Laid-Open Patent Publication No. 261379/1988 (Tokukaishou 63-261379), although it does not cause scratches on the surface of the image-bearing device, it requires a waste-toner collecting container; this makes it impossible to achieve a compact image-forming apparatus.

SUMMARY OF THE INVENTION

The objective of the present invention is to provide a cleaning means which can selectively remove only the foreign matters completely out of toner and foreign matters, such as paper particles, talc and kaolin, that remain on the surface of the image-bearing device after the transferring process, and also to provide an image-forming apparatus which has such a cleaning means and which is thus capable of producing copied images with good picture quality for a long time as well as achieving compactness of the apparatus.

In order to achieve the above-mentioned objective, the image-forming apparatus of the present invention is provided with:

(1) an image-bearing device for bearing a developer image on its surface;

(2) an electrostatic-latent-image forming means for forming an electrostatic latent image on the surface of the image-bearing device;

(3) a developing means for developing the electrostatic latent image formed on the surface of the image-bearing device by using developer that has been charged to have a predetermined polarity;

(4) a transferring means for transferring the developer image from the image-bearing device onto a transferring member by applying a charge with a polarity reversed to that of the charged electric potential of the developer onto the transferring member that is tightly in contact with the surface of the image-bearing device having the developer image formed thereon; and (5) a cleaning means for selectively removing foreign matters other than developer that remain on the surface of the image-bearing device after the transferring process. Further, the cleaning means is provided with:

(6) a cleaning member that is in contact with the surface of the image-bearing device and that allows foreign matters, which have been charged by the transferring means to have a polarity reversed to that of the charged electric potential of the developer, to adhere to the surface thereof by using an electric field that has been formed between the image-bearing device and the cleaning member; and (7) a electric potential-applying means for applying a electric potential to the cleaning member so that the surface of the cleaning member is charged to have a electric potential that is biased further toward the polarity of the charged toner than the surface electric potential of the image-bearing device at the contact portion between the cleaning member and the image-bearing device.

In the above-mentioned arrangement, the cleaning member, which have the predetermined electric potential applied by the electric potential-applying means, is kept in contact with the surface of the image-bearing device. Therefore, foreign matters, such as paper particles, talc and kaolin, which adhere to the surface of the image-bearing device, are separated from the surface of the image-bearing device and are allowed to adhere to the cleaning member. In contrast, the developer remaining on the surface of the image-bearing device does not adhere to the surface of the cleaning member, since it has the polarity reversed to that of the foreign matters. More specifically, the cleaning means, which is provided with the cleaning member, makes it possible to selectively remove only the foreign matters by utilizing the electrostatic force. Thus, it becomes possible to selectively remove only the foreign matters effectively out of foreign matters and developer that are adhering to the surface of the image-bearing device. Therefore, it is possible to provide an image-forming apparatus which is capable of producing images with high picture quality for a long time.

Further, in the above-mentioned arrangement, it is preferable to modify the developing means of (3) so as to include a developer-collecting means for collecting the developer that remains on the surface of the image-bearing device after the transferring operation. With this arrangement, a waste-developer collecting container, which used to be necessary in a conventional image-forming apparatus, is no longer required; therefore, it is possible to make the apparatus more compact. Moreover, this arrangement makes it possible to further reduce the use of developer compared to the conventional apparatus.

Further, as for the electric potential-applying means of (7), it is preferable to use a friction charging member which charges the surface of the cleaning member through friction, while contacting the surface of the cleaning member.

Moreover, the cleaning member of (6) is preferably provided with a dielectric member that contacts the surface of the image-bearing device. This arrangement makes it possible to prevent the cleaning member from injecting a charge to the surface of the image-bearing device, thereby maintaining the difference between the surface electric potentials of the image-bearing device and the cleaning member at a virtually constant value. Thus, the electric field, which is formed between the surfaces of the image-bearing device and the cleaning member, is stabilized, and consequently it becomes possible to remove foreign matters from the surface of the image-bearing device more positively.

Furthermore, the electrostatic-latent-image forming means of (2) is preferably provided with a contact charger that is capable of preventing ozone generation as a charging means for charging the surface of the image-bearing device prior to exposure. As for the contact charger, if a belt-like brush charger, which has brush hairs planted on a belt-shaped conductive substrate, is used, it is preferable to reciprocally oscillate the brush charger with a predetermined stroke and a predetermined oscillation frequency so that the oscillation is carried out with the top of the brush being kept in contact with the surface of the image-bearing device. This arrangement allows the brush charger to charge the surface of the image-bearing device uniformly, even when developer remains on the surface of the image-bearing device. As a result, it becomes possible to provide an image-forming apparatus which is capable of producing better images with high picture quality for a longer time.

For a fuller understanding of the nature and advantages of the invention, reference should be made to the ensuing detailed description taken in conjunction with the accompanying drawings.

DESCRIPTION OF THE EMBODIMENTS

[EMBODIMENT 1]

Figure 12:
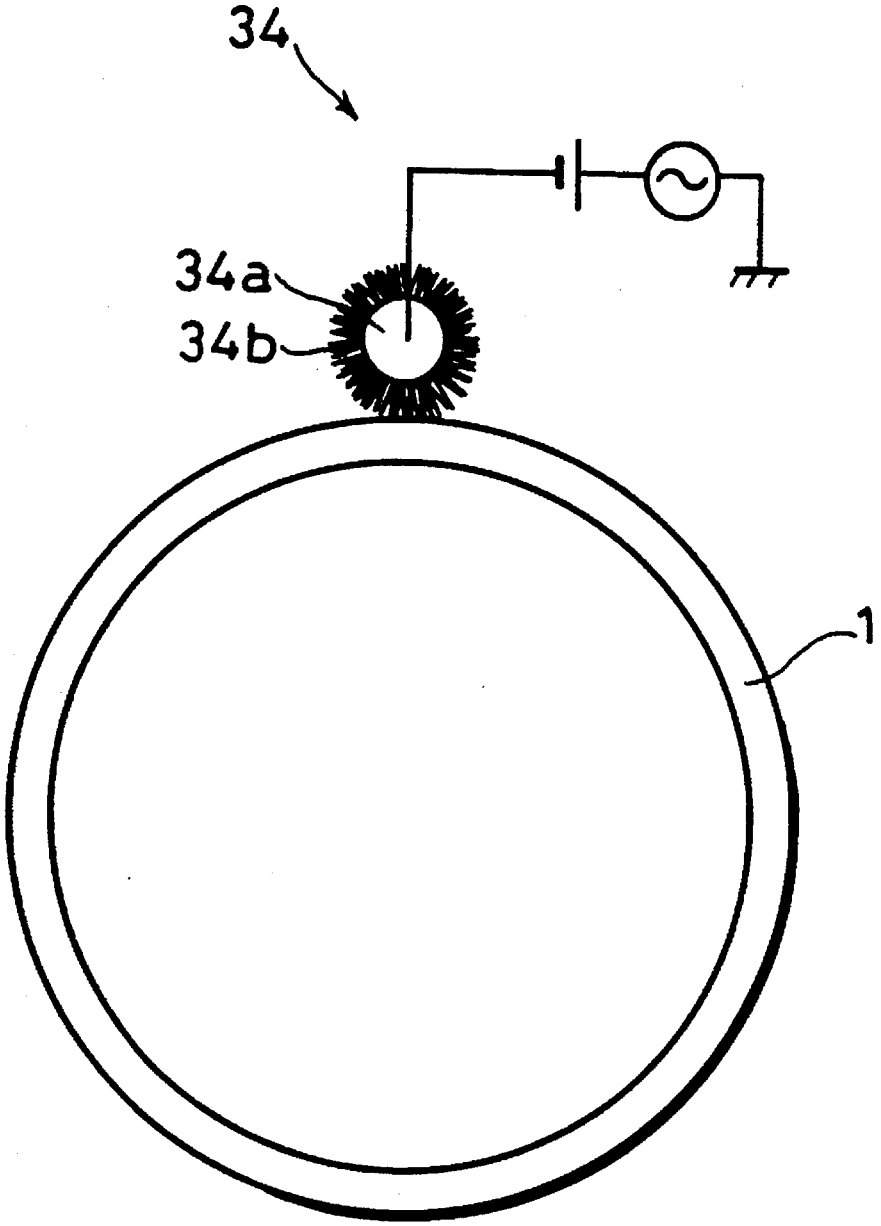
FIG. 12 is a schematic side view showing a roller-type brush charger.
Figure 13:
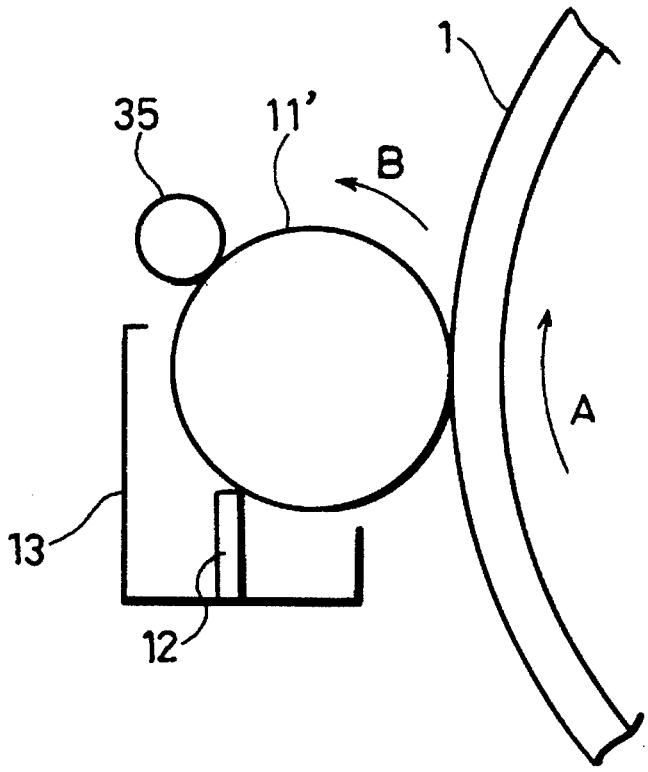
FIG. 13 a schematic side view showing one example of an arrangement wherein the surface of the foreign-matter removing roller is charged through friction.
Figure 14:
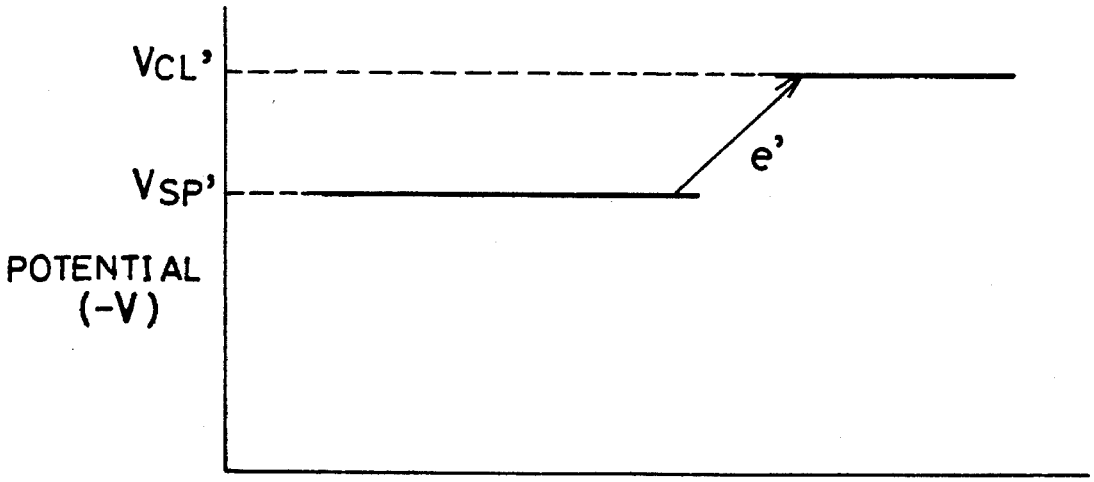
FIG. 14 is an explanatory drawing that shows a removing operation wherein a cleaning device, which is installed in a conventional image-forming apparatus, removes residual toner from the surface of a photoconductor drum.

Referring to FIGS. 1 through 4 as well as FIGS. 12 and 13, the following description will discuss one embodiment of the present invention. Here, in the following explanation, an electrophotographic printing machine which uses a positive developing method is given as an example of an image-forming apparatus.

Figure 1:
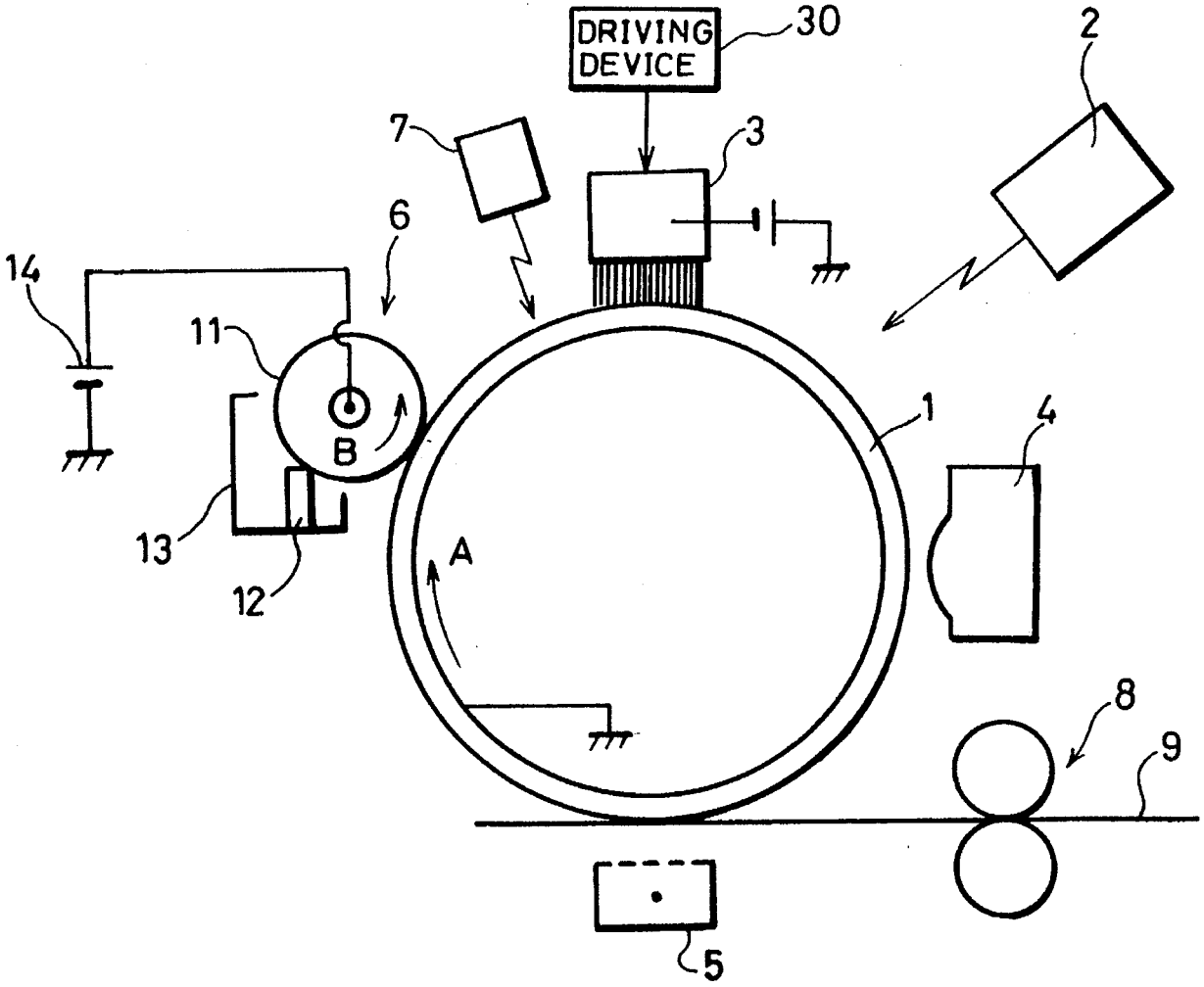
FIG. 1 is a schematic side view of an electrophotographic printing machine that is an example of an image-forming apparatus in one embodiment of the present invention.

In the electrophotographic printing machine of the present invention, a transferred image is obtained by using an electrostatic photographic process (electrostatic photographic method). As shown in FIG. 1, the electrophotographic printing machine is provided with a photoconductor drum 1 (image-bearing device) that is rotatable in the direction of arrow A and an exposure optical system 2 for exposing the surface of the photoconductor drum 1. The exposure optical system 2 illuminates light onto an original document, not shown, and directs a reflected light beam from the original document onto the photoconductor drum 1, thereby forming an electrostatic latent image on the photoconductor drum 1.

On the periphery of the photoconductor drum 1, is installed a main charger 3. Further, around the photoconductor drum 1, are installed the exposure optical system 2, a developing device 4, a transferring device 5, a cleaning device 6, a charge-eliminating lamp 7, and other devices in this order from the main charger 3 along the rotation direction of the photoconductor drum 1. Further, on the paper-feed side opposite the transferring device 5, is disposed a copy-paper transport path (not shown) that is provided with paired register rollers 8 and other members. The paired register rollers 8 supplies sheets of copy paper (copy material) 9 to the transferring device 5 in a timed relationship with it.

Figure 2:
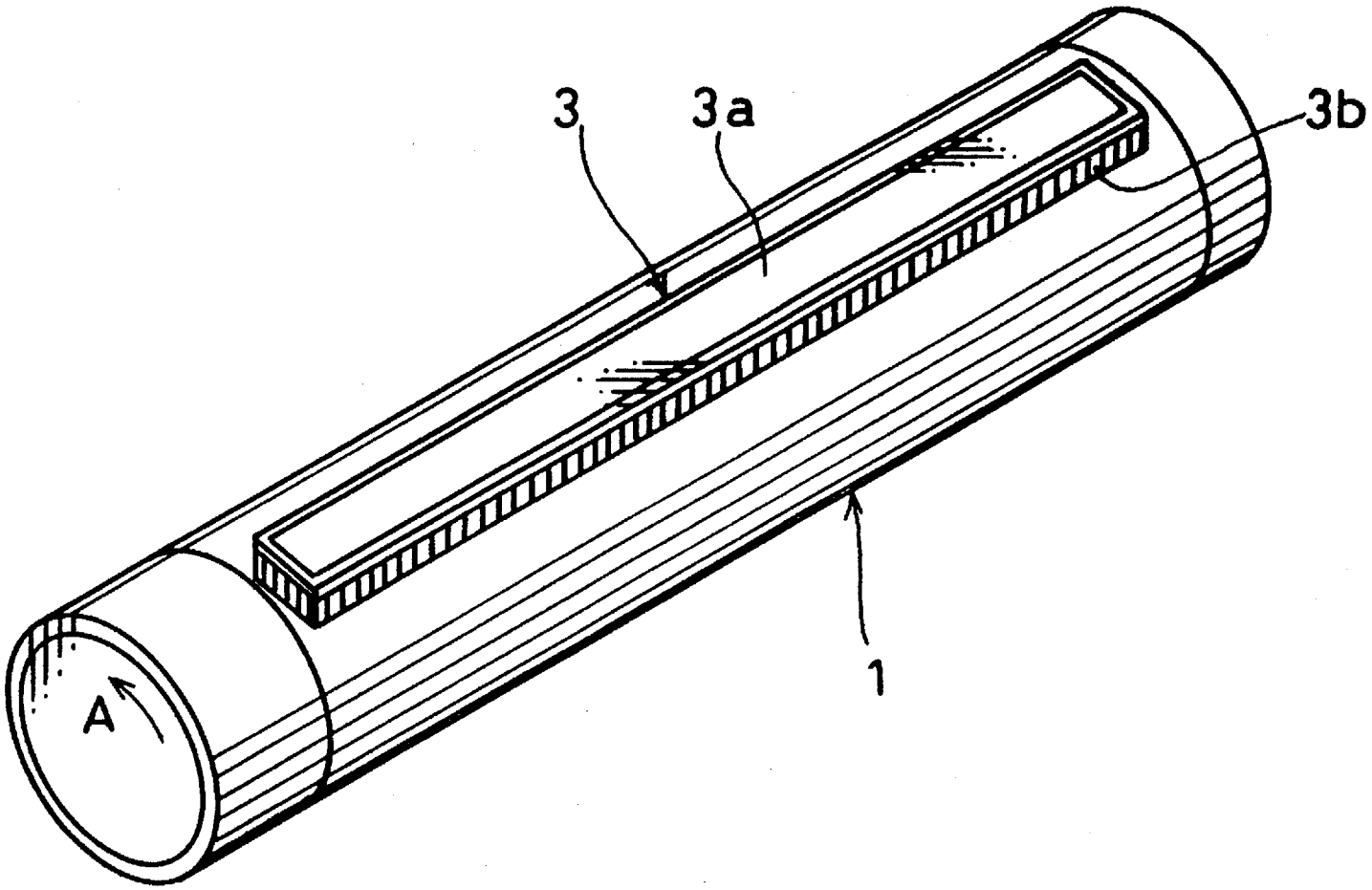
FIG. 2 is a schematic perspective view showing a photoconductor drum and a main charger that are installed in the electrophotographic printing machine.

As shown in FIG. 2, the main charger 3 (a brush charger) is constituted of a belt-like conductive base plate 3*a* that extends in the axial direction of the photoconductor drum 1 and brush-like semiconductive fibers 3b that are planted thereon. The main charger 3 contacts the surface of the photoconductor drum 1 and charges it to a predetermined electric potential, prior to exposure that is carried out by the exposure optical system 2. Additionally, dc voltage may be applied to the main charger 3, or so-called oscillating voltage, which is dc voltage on which ac voltage is superimposed, may be applied thereto. Since the main charger 3 charges the surface of the photoconductor drum 1 by the use of the contact charging method, there is no possibility of ozone generation.

As for the materials of the semiconductive fibers 3*b*, for example, rayon or other materials, wherein carbon particulates or other particulates are dispersed to add semiconductivity thereto, is preferably used. The diameter of the semiconductive fibers 3*b* is preferably set to, for example, 20 to 30 μm, and the length is preferably set to, for example, 5 mm to 10 mm. Further, the density of the planted semiconductive fibers 3*b* is preferably set to, for example, the number of $1\times10^5$/inch$^2$. Here, the diameter, length and density of the planted semiconductor fibers 3*b* are not necessarily limited to specific values. The main charger 3, which has such a construction, is less expensive than charging rollers made of synthetic resins.

Moreover, the main charger 3 is reciprocally oscillated by a driving device 30 (driving means) with a predetermined stroke and a predetermined oscillation frequency in the axial direction of the photoconductor drum 1 with its semiconductive fibers 3*b* kept in contact with the surface of the photoconductor drum 1. The stroke and oscillation frequency of the reciprocal oscillation are not necessarily limited to specific values. For example, the oscillation stroke may be set to approximately 10 mm and the oscillation frequency may be set to approximately 7 Hz. In addition, as for the reason why the main charger 3 is reciprocally oscillated in such a manner, a detailed explanation will be given later in Embodiment 2.

The developing device 4, which is provided with a developing roller, not shown, supplies developer (hereinafter, referred to as toner) onto an electrostatic latent image formed on the surface of the photoconductor drum 1 so as to form a toner image thereon. The transferring device 5 transfers the toner image onto a sheet of copy paper 9 by using, for example, the corona transferring method. In other words, the transferring device 5 allows the sheet of copy paper 9 to contact the photoconductor drum 1, and allows the toner image on the photoconductor drum 1 to be transferred onto the sheet of copy paper 9 by utilizing the electric potential difference between the charge of the toner image on the photoconductor drum 1 and the charge of the surface of the sheet of copy paper 9. The toner image, which has been transferred onto the sheet of copy paper 9, is fixed onto the sheet of copy paper 9 by a fixing device, not shown. Thus, the electrophotographic printing machine forms a transferred image on the sheet of copy paper 9. The charge-eliminating lamp 7 eliminates residual electric potential from the surface of the photoconductor drum 1 prior to the next charging operation. Additionally, the charge-eliminating lamp 7 is installed, if necessary.

The cleaning device 6 removes foreign matters remaining on the surface of the photoconductor drum 1 after the toner image has been transferred therefrom. The foreign matters are, for example, minute paper particles derived from the sheet of copy paper 9, talc, kaolin and other matters.

Figure 3:
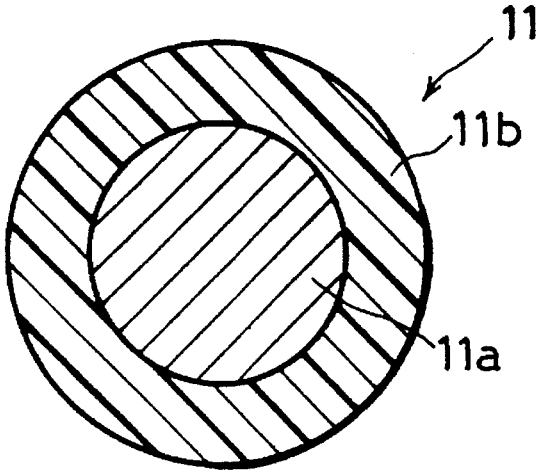
FIG. 3 is a cross-sectional view of a foreign-matter removing roller in a cleaning device installed in the electrophotographic printing machine.

The cleaning device 6 is constituted of a foreign-matter removing roller 11, a scraping member 12, a foreign-matter collecting container 13, and a electric potential-applying member 14. The foreign-matter removing roller 11 (cleaning means), which is in contact with the photoconductor drum 1, is allowed to rotate in the direction of arrow B (so-called passive rotation), following the rotation of the photoconductor drum 1 in the direction of arrow A. As shown in FIG. 3, the foreign-matter removing roller 11 is constituted of a shaft 11*a* made of metal and a synthetic-resin layer 11*b* that is laid over the side surface of the shaft 11*a*. Here, a predetermined electric potential is applied to the shaft 11*a* by the potential-applying member 14. The synthetic-resin layer 11*b* is installed in the form of a concentric circle with the shaft 11*a*, and allows foreign matters to adhere to the surface thereof.

As for the materials of the synthetic-resin layer 11*b*, for example, urethane or other materials, wherein particulates of copper, carbon and other materials are dispersed to add semiconductivity thereto, is preferably used, but the materials are not specifically limited thereto. The diameter of the foreign-matter removing roller 11 is not specifically limited. For example, the diameter of the foreign-matter removing roller 11 may be set to approximately 10 mm, and the diameter of the shaft 11*a* may be set to approximately 4 mm. Additionally, the foreign-matter removing roller 11 may be designed so that it is driven by a driving device 30 to rotate in the direction of arrow B while kept in contact with the photoconductor drum 1.

The scraping member 12 scrapes foreign matters from the surface of the foreign-matter removing roller 11 to which they adhere so as to always keep the surface of the foreign-matter removing roller 11 clean. The foreign-matter collecting container 13 stores the foreign matters that have been scraped by the scraping member 12. The electric potential-applying member 14 applies a predetermined electric potential (which will be described later) to the foreign-matter removing roller 11.

Figure 4:
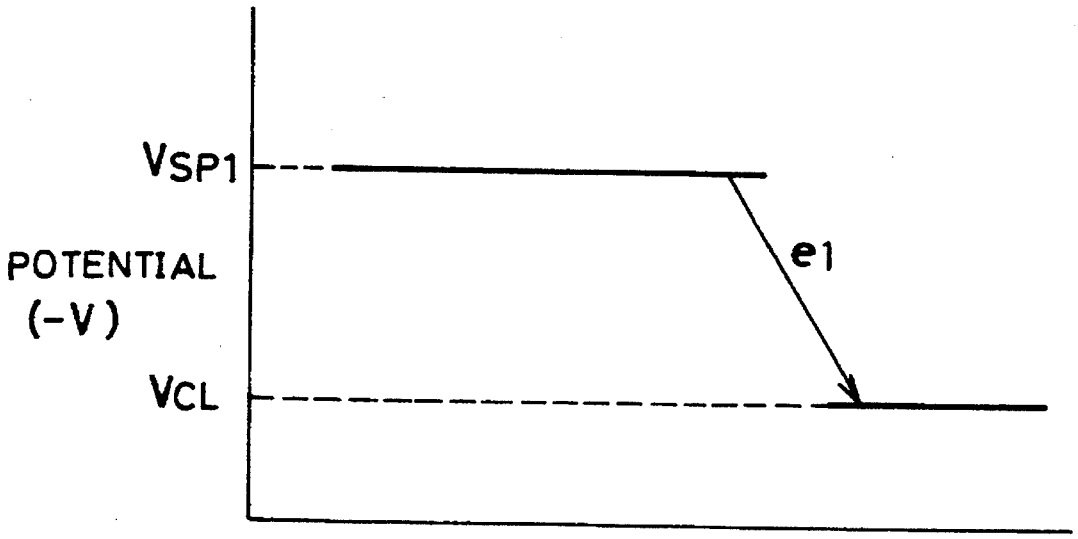
FIG. 4 is an explanatory drawing that shows a removing operation which is carried out by the foreign-matter removing roller in order to remove foreign matters from the surface of the photoconductor drum.

Referring to FIG. 4, the following description will discuss the removing operation of foreign matters from the surface of the photoconductor drum 1 that is carried out by the foreign-matter removing roller 11 in the cleaning device 16. Here, in the following description, a case in which an organic photoconductor drum (OPC) is used as the photoconductor drum 1 is exemplified.

As shown in FIG. 4, the photoconductor drum 1 is first charged by the main charger 3 so that its surface has a predetermined negative electric potential $V_{SP1}$. Next, the photoconductor drum 1, charged to have the negative electric potential, is subjected to reflected light from an original document, and is allowed to have an electrostatic latent image on its surface. Then, the electrostatic latent image is developed by toner that has been charged to have positive electric potential, and is transferred onto a sheet of copy paper 9 by the transferring device 5 to which a negative voltage whose absolute value is greater than that of the above-mentioned negative electric potential $V_{SP1}$ has been applied. Thus, the transferring operation of the toner image onto the sheet of copy paper 9 is completed.

Foreign matters, which have adhered to the photoconductor drum 1 upon the transferring operation, are subjected to a negative voltage applied by the transferring device 5, and are negatively charged. Since the foreign matters have a high electrical insulating property, they tend to keep a charged state for long hours once they have been negatively charged. In other words, the foreign matters maintain their charged state until they reach the installation position of the foreign-matter removing roller 11 through the rotation of the photoconductor drum 1.

Meanwhile, the toner, which has been positively charged, maintains its positively charged state, although its amount of charge is lowered by the application of negative voltage from the transferring device 5.

Here, to the foreign-matter removing roller 11 is applied from the electric potential-applying member 14 a electric potential reversed to that of the charged electric potential $V_{SP1}$ of the photoconductor drum 1, that is, a electric potential whose polarity is reversed to the transferring polarity of the transferring device 5 (namely, positive electric potential), or a negative electric potential $V_{CL}$ whose absolute value is smaller than that of the charged electric potential of the photoconductor drum 1 at the portion that comes into contact with the foreign-matter removing roller 11. Then, the foreign materials, which have been negatively charged, are affected by an electric field $e_1$ that has been formed by the photoconductor drum 1 and the foreign-matter removing roller 11, and are separated from the surface of the photoconductor drum 1 to adhere to the foreign-matter removing roller 11. Meanwhile, the toner, which has been positively charged, that is, the residual toner, is not affected by the electric field $e_1$, and is maintained in its adhering state on the surface of the photoconductor drum 1.

With this arrangement, it becomes possible for the foreign-matter removing roller 11, that is, for the cleaning device 6, to selectively remove only the foreign matters out of the toner and the foreign matters that remain on the surface of the photoconductor drum 1. Here, there is no possibility of damage to the surface of the photoconductor drum 1 caused by the foreign-matter removing roller 11.

As described above, the cleaning device 6 is capable of selectively removing only foreign matters by using an electrostatic force. Therefore, the removing operation for removing foreign matters from the surface of the photoconductor drum 1, provided by the present cleaning device 6, is completely different from the conventional cleaning device that has been proposed by the aforementioned Japanese Laid-Open Patent Publication 60-107678, that is, the cleaning device wherein the residual toner is removed by using an electrostatic force.

Additionally, in the above-mentioned cleaning device 6, the arrangement for applying a predetermined electric potential to the foreign-matter removing roller 11 is not intended to be limited to the electric potential-applying member 14. For example, instead of installing the foreign-matter removing roller 11, a friction member 35 shown in FIG. 13, which is allowed to contact a foreign-matter removing roller 11' and which charges the foreign-matter removing roller 11' by static electricity produced through its friction with the foreign-matter removing roller 11', may be installed. Moreover, another arrangement may be adopted wherein the foreign-matter removing roller 11' is charged by static electricity generated by its friction with the scraping member 12. In this case, the scraping member 12 functions as the friction member. Furthermore, still another arrangement may be adopted wherein the foreign-matter removing roller 11' is brought into contact with the photoconductor drum 1, and static electricity generated through the friction between the foreign-matter removing roller 11' and the photoconductor drum 1 is used for charging the foreign-matter removing roller 11'. In this case, the photoconductor drum 1 functions as the friction member. In these arrangements wherein static electricity, generated through friction, is used for charging the foreign-matter removing roller 11', it is not necessary to install the electric potential-applying member 14; thus, it becomes possible to reduce the cost of the cleaning device 6, that is, the cost of the electrophotographic printing machine. Moreover, when the charging operation is carried out by using static electricity generated through friction, it is possible to alleviate a so-called charge-accumulating phenomenon that is caused in the foreign-matter removing roller 11'.

For example, in the case when the charging operation is carried out by using static electricity generated by the friction with the photoconductor drum 1 whose charge carrier transport layer (CTL) is made of polycarbonate, the material of the synthetic resin layer **11*b* of the foreign-matter removing roller 11' is preferably selected from the following synthetic resins. In the case of positive charge to be applied to the foreign-matter removing roller 11, polyamide, cellulose, polyethylene-terephthalate and other materials are listed. In the case of negative charge to be applied to the foreign-matter removing roller 11**, fluororesin, polyvinylidene chloride, polyethylene and other materials are listed.

Moreover, another arrangement may be adopted wherein a dielectric film (not shown) is provided in a sandwiched manner between the foreign-matter removing roller 11 and the photoconductor drum 1. Additionally, such an arrangement having a dielectric film between the foreign-matter removing roller 11 and the photoconductor drum 1 will be described in detail in Embodiment 6 later.

Meanwhile, after the above-mentioned removing operation has been carried out by the foreign-matter removing roller 11 of the cleaning device 6, residual toner remaining on the surface of the photoconductor drum 1 passes through the installation position of the main charger 3, and reaches the developing device 4. Thus, the residual toner is collected into the developing device 4. Therefore, the residual toner does not adversely affect the picture quality of toner images, that is, transferred images. The residual toner, thus collected, is again used for forming toner images. This makes it possible to reduce the consumption of toner compared to conventional arrangements.

As described above, it becomes possible for the electrophotographic printing machine to provide transferred images with good picture quality for a long time by using the above-mentioned removing operation of the cleaning device 6. Moreover, since no waste-toner collecting container is required, it becomes possible to make the machine compacter.

Referring to experimental examples, a more detailed explanation will be given on the removing operation of the cleaning device 6 in the electrophotographic printing machine having the above-mentioned arrangement. Here, in the following experimental examples, an organic photoconductor drum having a diameter of 30 mm was used as the photoconductor drum 1. Moreover, a roller, which has a shaft **11*a* having a diameter of 4 mm and has a synthetic-resin layer 11*b* of semiconductive urethane resin (3 mm in thickness) having a resistance of $10^6$ Ω to $10^8$ Ω, was used as the foreign-matter removing roller 11 in the cleaning device 6**.

First, the surface of the photoconductor drum 1 was charged to −750 V by the main charger 3. At this time, the current, flowed into the photoconductor drum 1 from the main charger 3, was virtually 10 μA. Further, the shaft **11*a* of the foreign-matter removing roller 11 was charged to 200 V by the electric potential-applying member 14. Next, light was projected onto a white original document of A-4 size by the exposure optical system 2, and the reflected light from the white original document was directed to the photoconductor drum 1; thus, an electrostatic latent image was formed on the photoconductor drum 1. Next, toner was supplied onto the electrostatic latent image by the developing device 4; thus, a toner image was formed. Then, the toner image was transferred onto a sheet of copy paper 9 of A-4 size by the transferring device 5. At this time, the current, flowed into the sheet of copy paper 9 from the transferring device 5 (the negative polarity of voltage), was virtually 2 μA to 3 μA. Moreover, the charged electric potential of the surface of the photoconductor drum 1, marked immediately before passing the installation position of the foreign-matter removing roller 11, was −900 V. These transferring operations were repeated until the number of the transferring operations reached virtually 1000 times (that is, until 1000 copies were made). Additionally, since the white original document was used, no transferred images were actually formed on the sheets of copy paper 9**.

After completion of these transferring operations, an examination was made on materials stored inside the foreign-matter collecting container 13 of the cleaning device 6, and it was found that white matters, which were certainly recognized as foreign matters such as paper powder, talc and kaoline, were deposited therein. Moreover, no toner was deposited inside the foreign-matter collecting container 13. Furthermore, none of black spots, black lines and other stains were found on the sheets of copy paper 9; this ensured that it is possible to obtain transferred images with good picture quality for a long time.

In addition, in the case where the main charger 3 was not the above-mentioned contact charger, but a corona charger, such as corotron or scorotron, that applies corona charge to the photoconductor drum 1, it was found that white matters, which were certainly recognized as the foreign matters, were deposited inside the foreign-matter collecting container 13 in the same manner as described above. Further, none of black spots, black lines and other stains were found on the sheets of copy paper 9.

As described above, the electrophotographic copying machine of the present invention is provided with: the foreign-matter removing roller 11 that is in contact with the surface of the photoconductor drum 1 and that allows foreign matters, which have been charged to have a polarity reversed to that of the charged electric potential of the toner by the charge applied by the transferring device 5, to adhere to the roller surface by using an electric field that has been formed between the photoconductor drum 1 and the foreign-matter removing roller 11; and the electric potential-applying member 14 for applying a electric potential to the surface of the foreign-matter removing roller 11 so that the surface of the foreign-matter removing roller 11 is charged to have a electric potential that is biased further toward the polarity of the charged toner than the surface electric potential of the photoconductor drum 1 at the contact portion between the foreign-matter removing roller 11 and the photoconductor drum 1.

With this foreign-matter removing roller 11, it is possible to allow foreign matters, such as paper powder, talc and kaoline, adhering to the surface of the photoconductor drum 1 to be removed from the surface of the photoconductor drum 1 and to adhere to the foreign-matter removing roller 11. Moreover, the charged electric potential of toner remaining on the surface of the photoconductor drum 1 has a polarity reversed to that of the foreign matters; this makes it possible to prevent the toner from adhering to the foreign-matter removing roller 11.

Therefore, it becomes possible to selectively remove only the foreign matters out of the toner and the foreign matters that remain on the surface of the photoconductor drum 1 sufficiently. This makes it possible to provide an electrophotographic printing machine, that is, an image forming apparatus, which is capable of supplying images with good picture quality for a long time.

Further, when the developing device 4 is modified to have a residual-toner collecting function, a waste-toner collecting container, which has been used in conventional electrophotographic printing machines, is no longer required; this makes the machine compacter. Moreover, it becomes possible to reduce the consumption of toner, compared to the conventional machines.

Additionally, in the above-mentioned embodiment, an electrophotographic printing machine was exemplified as the image-forming apparatus; however, laser-beam printers or other apparatuses, which use the reverse developing method, may be adopted as the image-forming apparatus. Moreover, in the image-forming apparatus, the cleaning device 6 and a cleaning blade may be used combinedly, if necessary.

Moreover, the main charger 3 is not limited to the one having the above-mentioned arrangement. As for the contact charger that directly applies voltage to the surface of the photoconductor drum 1, it is possible to adopt a roller-type brush charger 34, shown in FIG. 12, besides the belt-like brush charger shown in FIG. 2. The roller-type brush charger 34 is made of a conductive roller 34*a* that is installed in a freely rotatable fashion and that extends in the axial direction of the photoconductor drum 1, and semiconductive fibers (or conductive fibers) 34*b* are planted around the conductive roller 34*a*. In addition, for example, charging rollers made up of synthetic resin, such as conductive rubber and semiconductive rubber, may be used as the charging means. In general, charging rollers have a longer life than brush chargers. Additionally, plate-like charging blades made up of synthetic resin, such as conductive rubber and semiconductive rubber, may be used as the charging means.

Furthermore, the transferring device 5 is not limited to the one having the above-mentioned arrangement. Any transferring means, selected from various prior-art arrangements, may be applied to the present invention as long as it utilizes the electrostatic transferring method, wherein copy paper 9, which is pressed onto the surface of the photoconductor drum 1 having a toner image formed thereon, is subject to a charge having a polarity reversed to that of the charge of the toner so that the toner image is electrostatically transferred from the photoconductor drum 1 to the copy paper 9. As for the transferring means using the electrostatic transferring method, roller transferring devices are listed in addition to the corona transferring devices. In the roller transferring devices, voltage is directly applied to copy paper 9 through a conductive roller or a semiconductive roller that rotates while pressing the copy paper 9 onto the photoconductor drum 1. In addition, belt transferring devices are also listed as the transferring means using the electrostatic transferring method.

[EMBODIMENT 2]

Figure 5:
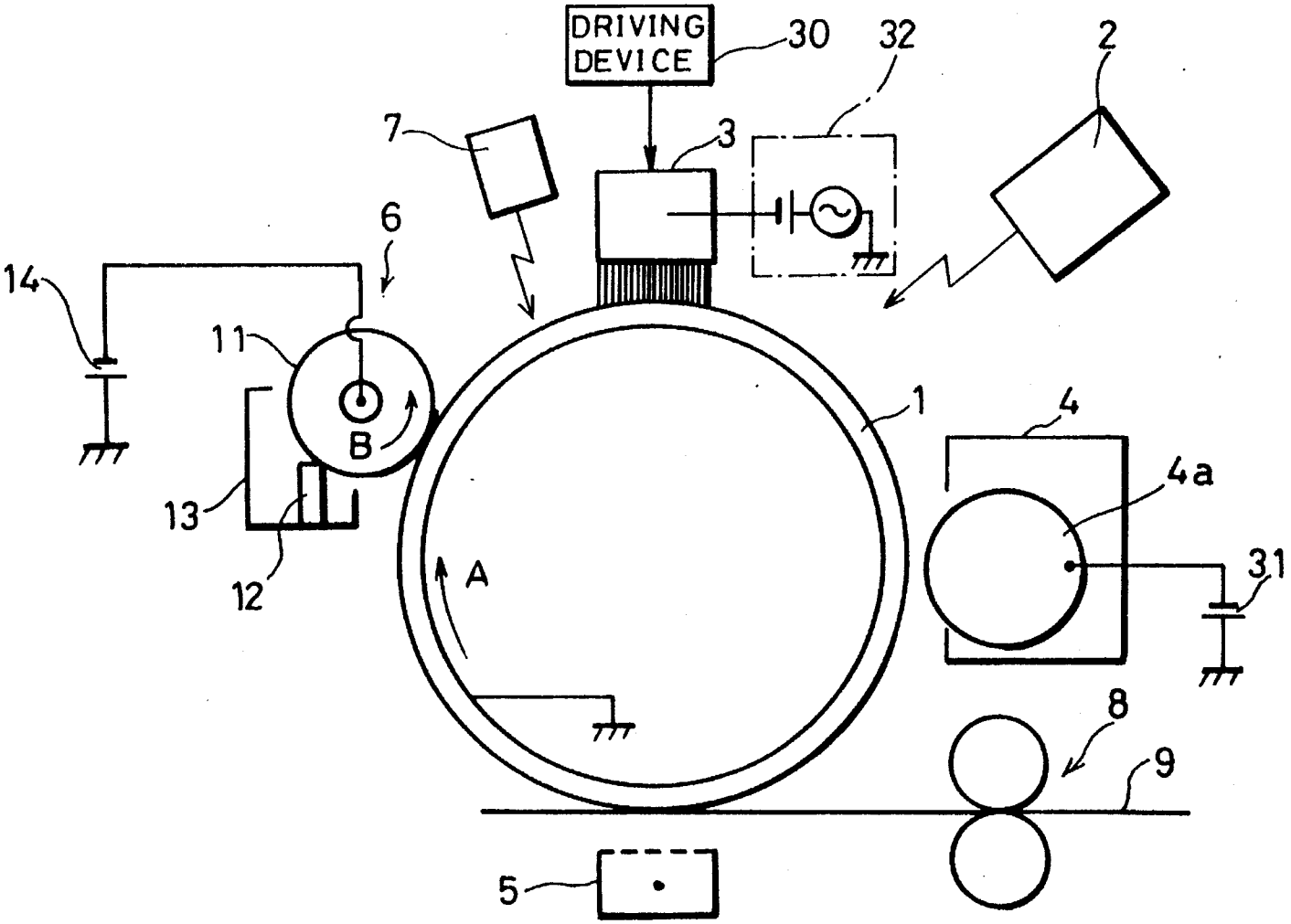
FIG. 5 a schematic side view of an electrophotographic printing machine that is an example of an image-forming apparatus in another embodiment of the present invention.
Figure 6:
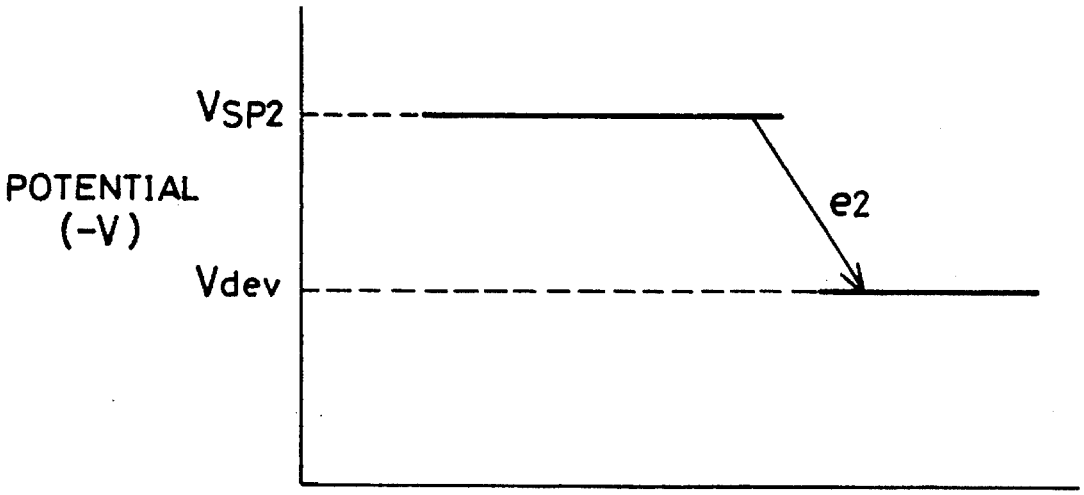
FIG. 6 is an explanatory drawing that shows a collecting operation wherein a developing device, which is installed in the electrophotographic printing machine of FIG. 5, collects residual toner from the surface of the photoconductor drum.

Referring to FIGS. 5 and 6, the following description will discuss another embodiment of the present invention. Here, for convenience of explanation, those members that have the same functions and that are described in Embodiment 1 are indicated by the same reference numerals and the description thereof is omitted.

In the electrophotographic printing machine of the present embodiment, a transferred image is obtained by using the electrostatic photographic process and adopting the reverse developing method. In other words, as shown in FIG. 5, a negative electric potential is applied to the developing roller 4*a* of the developing device 4 as its developing bias voltage. Therefore, the toner is negatively charged, and a positive voltage is applied to the transferring device 5. The other arrangements of the electrophotographic printing machine is virtually the same as those of the electrophotographic printing machine in Embodiment 1. Additionally, in the electrophotographic printing machine of the present embodiment, a driving device 30 is provided in the same manner as in the electrophotographic printing machine of Embodiment 1. The driving device 30 reciprocally oscillates the main charger 3 for charging the surface of the photoconductor drum 1 with a predetermined stroke and a predetermined oscillation frequency in the axial direction of the photoconductor drum 1 with the main charger 3 kept in contact with the surface of the photoconductor drum 1.

In the electrophotographic printing machine having the above-mentioned arrangement, the following description will discuss a collecting operation of the developing device 4 for collecting residual toner on the surface of the photoconductor drum 1, with reference to FIG. 6.

As shown in FIG. 6, a non-exposure portion (corresponding to an electrostatic latent image portion) of the surface of the photoconductor drum 1 with residual toner adhering thereto, which has reached the developing device 4, is maintained at a charged state having a negative electric potential of $V_{SP2}$. Meanwhile, to the developing roller 4*a* of the developing device 4, a negative electric potential $V_{dev}$, whose absolute value is smaller than that of the charged electric potential $V_{SP2}$ of the photoconductor drum 1, is applied from a developing power source 31 as a developing bias voltage. For this reason, the residual toner, which is affected by an electric field $e_2$ that is formed by the photoconductor drum 1 and the developing roller 4*a*, is separated from the surface of the photoconductor drum 1, and is collected by the developing device 4. Thus, the developing device 4 collects the residual toner through the above-mentioned collecting operation. Here, an exposed portion (corresponding to a non electrostatic latent image portion) of the surface of the photoconductor drum 1, where the charge is removed by exposure, has a positive electric potential, compared to the developing bias voltage $V_{dev}$; therefore, the toner, negatively charged, is allowed to adhere to the exposed portion, and the electrostatic latent image is formed appropriately. Therefore, the residual toner does not adversely affect the picture quality of toner images, that is, transferred images. The residual toner, thus collected, is again used for forming toner images. This makes it possible to reduce the consumption of toner compared to conventional arrangements.

As described above, it becomes possible for the electrophotographic printing machine to provide transferred images with good picture quality for a long time by using the above-mentioned collecting operation of the developing device 4. Moreover, since no waste-toner collecting container is required, it becomes possible to make the machine compacter.

Meanwhile, the residual toner remaining on the surface of the photoconductor drum 1, when passing through the installation position of the main charger 3, has its some portion to adhere to the semiconductive fibers 3*b* of the main charger 3. Here, in order to prevent the residual toner adhering to the semiconductive fibers 3*b* from giving adverse effects on the picture quality of toner images, that is, transferred images, the main charger 3 is oscillated reciprocally by the driving device 30 with a predetermined stroke and a predetermined oscillation frequency in the axial direction of the photoconductor drum 1. The following description will discuss the reason that the main charger 3 is reciprocally oscillated in this manner.

Supposing that the main charger 3 is fixed to a predetermined position, the following problem is raised. When the residual toner partially adheres to the semiconductive fibers 3*b*, imperfect contact occurs between the semiconductive fibers 3*b* and the surface of the photoconductor drum 1. Consequently, the portions of the surface of the photoconductor drum 1, which are subjected to the imperfect contact, are merely charged to a negative electric potential whose absolute value is smaller than that of a predetermined negative electric potential $V_{SP1}$. In other words, the imperfect-contact portions are brought into a state suffering from insufficient charged electric potential.

Therefore, the imperfect-contact portions are in a state that is virtually the same as the state having an electrostatic latent image formed therein by the exposure optical system 2, and when toner is supplied thereto by the developing device 4, black spots and black lines, which are toner images, are formed on the imperfect-contact portions. Further, these black spots and black lines appear even at a stage where the number of the transferring operations (that is, the number of copies) is still comparatively small, and the number and the densities of the black spots and black lines increase as the number of the transferring operations increases. Furthermore, as the number of the transferring operations increase, the amount of residual toner adhering to the black spots and the black lines increases; this reduces adherence between the photoconductor drum 1 and the sheet of copy paper 9, causing white spots and white lines to be formed due to malfunction in the transferring operations and other problems. Additionally, the black lines and the white lines are formed along the rotation direction (in the direction of arrow A) of the photoconductor drum 1.

When the black spots and the black lines, as well as the white spots and the white lines, are formed, the picture quality of the resulting transferred images is extremely lowered since the black spots and the black lines, as well as the white spots and the white lines, are superimposed thereon. In particular, the problem of the lowering of picture quality is aggravated in the case of so-called transferred images with half tone.

With the arrangement wherein the main charger 3, that is, the semiconductive fibers 3*b*, is oscillated reciprocally with a predetermined stroke and a predetermined oscillation frequency in the axial direction of the photoconductor drum 1, it is possible to solve the above-mentioned problem. In other words, even if the residual toner adheres to some portions of the semiconductive fibers 3*b*, the chance and time of contact between the semiconductive fibers 3*b* and the surface of the photoconductor drum 1 can be actually increased by reciprocally oscillating the semiconductive fibers 3*b* on the surface of the photoconductor drum 1. That is, even if the residual toner adheres to some portions of the semiconductive fibers 3*b*, the residual toner on the surface of the photoconductor drum 1 can be scattered by reciprocally oscillating the main charger 3. This makes it possible to maintain the surface of the photoconductor drum 1 at a uniformly charged state as a whole without having adverse effects from the residual toner. Moreover, it is possible to eliminate the so-called malexposure due to the residual toner.

In this case, it is more preferable to apply the so-called oscillating voltage, which is dc voltage on which ac voltage is superimposed, to the main charger 3 than to apply dc voltage thereto; this makes migration of electric charge between the semiconductive fibers 3*b* and the surface of the photoconductor drum 1 more active, and makes it possible to maintain the surface of the photoconductor drum 1 at a more uniformly charged state as a whole. For example, as shown in FIG. 5, in the case when an oscillating voltage was applied to the main charger 3 from a charging power source 32, neither the black spots and black lines, nor the white spots and white lines, were formed even if the number of the transferring operations (that is, the number of copies) reached not less than 20000 times. This ensures that transferred images with good picture quality are obtainable for a long time.

The ac voltage of the oscillating voltage (that is, peak-to-peak voltage) is preferably set to not more than two times of a break-down voltage that is determined depending on the materials of the main charger 3 and the photoconductor drum 1 or the installation conditions or other factors of the main charger 3 and the photoconductor drum 1 (that is, the electrophotographic printing machine). Here, the break-down voltage is a voltage at which a charge is initiated between the surface of the photoconductor drum 1 and the main charger 3. For example, if the break-down voltage is virtually set to 450 V, the peak-to-peak voltage of the oscillating voltage is preferably set to not more than 900 V. This is because if the peak-to-peak voltage exceeds two times of the break-down voltage (for example, 1100 V in the above-mentioned example), unwanted black lines are formed along the axial direction of the photoconductor drum 1, although the reason for this has not been clarified yet.

Additionally, when no cleaning device 6 is installed, black spots and black lines appear with the transferring operations of virtually 100 times, even if the main charger 3 is reciprocally oscillated in the same manner as described above. The reason for this is that foreign matters adhere to some portions of the semiconductive fibers 3*b* so that imperfect contact occurs between the semiconductive fibers 3*b* and the surface of the photoconductor 1, thereby causing an insufficient charged electric potential at the imperfect-contact portions.

As described above, the electrophotographic printing machine in the present embodiment is provided with a driving device 30 which reciprocally oscillates the main charger 3 for charging the surface of the photoconductor drum 1 with a predetermined stroke and a predetermined oscillation frequency in the axial direction of the photoconductor drum 1 with the main charger 3 in contact with the surface of the photoconductor drum 1. With this arrangement, it becomes possible for the main charger 3 to uniformly charge the surface of the photoconductor drum 1, even if toner remains on the surface of the photoconductor drum 1.

Thus, it is possible to achieve an electrophotographic printing machine, that is, an image-forming apparatus, that is capable of providing images with good picture quality for a longer period of time.

[EMBODIMENT 3]

Figure 7:
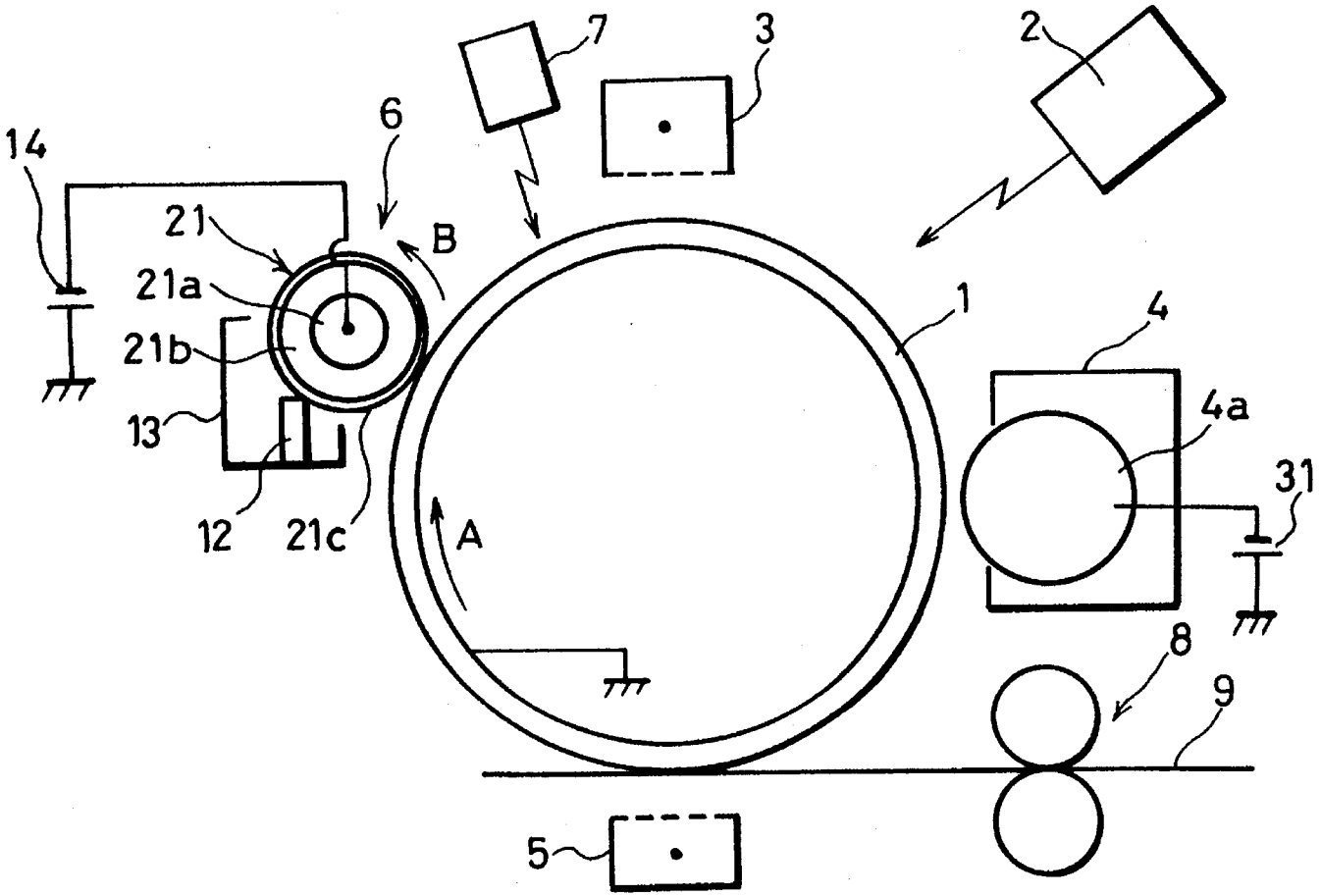
FIG. 7 is a schematic side view of an electrophotographic printing machine that is an example of an image-forming apparatus in still another embodiment of the present invention.
Figure 8:
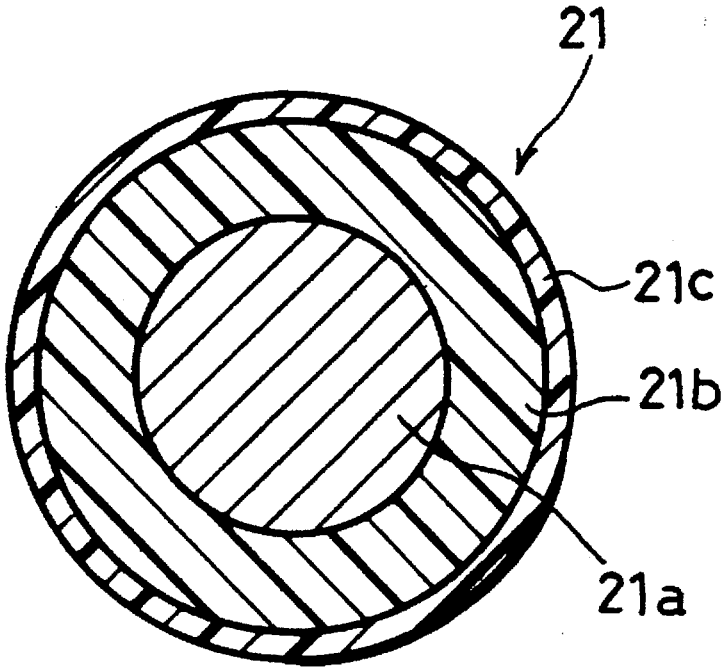
FIG. 8 is a cross-sectional view of a foreign-matter removing roller in a cleaning device installed in the electrophotographic printing machine of FIG. 7.

Referring to FIGS. 7 and 8, the following description will discuss still another embodiment of the present invention. Here, for convenience of explanation, those members that have the same functions and that are described in Embodiment 2 with reference to its drawings are indicated by the same reference numerals and the description thereof is omitted.

As shown in FIG. 7, in the electrophotographic printing machine of the present embodiment, the main charger 3 is a corona charger made of scorotron and the photoconductor drum 1 is subjected to a corona charging operation. Further, in the electrophotographic printing machine of the present embodiment, another foreign-matter removing roller 21, shown in FIG. 8, is provided instead of the foreign-matter removing roller 11 of Embodiment 2 (that is, of Embodiment 1). The foreign-matter removing roller 21 (cleaning means) is constituted of a shaft 21*a* made of metal, a synthetic-resin layer 21*b* that is laid over the side surface of the shaft 21*a*, and a synthetic-resin layer 21*c* (dielectric material) that is laid over the surface of the synthetic-resin layer 21*b*. As shown in FIG. 7, the electric potential-applying member 14 applies a predetermined negative voltage to the shaft 21*a*. The synthetic-resin layers 21*b* and 21*c* are installed in the form of concentric circles with respect to the shaft 21*a*. The synthetic-resin layer 21*c* allows foreign matters to adhere to its surface.

As for the materials of the synthetic-resin layer 21*b*, for example, silicone resin or other materials, to which conductivity is added, is preferably used, but the materials are not specifically limited. Further, as for the materials of the synthetic-resin layer 21*c*, dielectric synthetic resins having smoothness in their surface, such as polyethylene terephthalate and fluororesin, are preferably used, but the materials are not specifically limited. Moreover, the diameter of the foreign-matter removing roller 1 and the thicknesses of the synthetic-resin layers 21*b* and 21*c* are not specifically limited. The other arrangements of the electrophotographic printing machine are the same as those of the electrophotographic printing machine of the aforementioned Embodiment 2.

In the above-mentioned arrangement wherein the surface portion of the foreign-matter removing roller 21 is made of a dielectric material, when a bias voltage is applied to the shaft 21*a* from the electric potential-applying member 14, a charge appears on the surface portion due to the polarization of the dielectric material. Further, the bias voltage of the electric potential-applying member 14 can be adjusted so as to adjust the surface electric potential of the foreign-matter removing roller 21. The surface electric potential of the foreign-matter removing roller 21 is adjust to such a electric potential that foreign matters, which are charged to have the transferring polarity due to the electric field formed between the surface of the photoconductor drum 1 and the surface of the foreign-matter removing roller 21, are allowed to adhere to the surface of the foreign-matter removing roller 11.

Referring to experimental examples, an explanation will be given below on the removing operation of the cleaning device 6 in the electrophotographic printing machine having the above-mentioned arrangement. Here, in the following experimental examples, an organic photoconductor drum having a diameter of 30 mm was used as the photoconductor drum 1. Moreover, a roller, which has a synthetic-resin layer 21*b* of conductive silicone resin (2 mm in thickness) having a resistance of not more than $10^3$ Ω and a synthetic-resin layer 21*c* of polyethylene terephthalate (20 μm in thickness) having a resistance of not less than $10^{12}$ Ω, was used as the foreign-matter removing roller 21 in the cleaning device 6.

First, the surface of the photoconductor drum 1 was charged to −550 V by the main charger 3. At this time, the current, flowed into the photoconductor drum 1 from the main charger 3, was virtually 9 μA. Further, the shaft 21*a* of the foreign-matter removing roller 21 was charged to −500 V by the electric potential-applying member 14. Next, the exposure optical system 2 projected light onto an original document of A-4 size with a printed portion of 4% of its entire surface, and the reflected light from the original document was directed to the photoconductor drum 1; thus, an electrostatic latent image was formed on the photoconductor drum 1. Next, toner was supplied onto the electrostatic latent image by the developing device 4; thus, a toner image was formed. At this time, the developing bias voltage of the developing roller 4*a* in the developing device 4 was —350 V. Thereafter, the toner image was transferred onto a sheet of copy paper 9 of A-4 size by the transferring device 5. At this time, the current, flowed into the sheet of copy paper 9 from the transferring device 5 (the positive polarity of voltage), was virtually 3 μA. Moreover, the charged electric potential of the surface of the photoconductor drum 1, marked immediately before passing the installation position of the foreign-matter removing roller 21, was 0 V to −200 V. These transferring operations were repeated until the number of the transferring operations reached virtually 1000 times (that is, until 1000 copies were made).

After completion of these transferring operations, an examination was made on materials stored inside the foreign-matter collecting container 13 of the cleaning device 6, and it was found that white matters, which were certainly recognized as foreign matters such as paper powder, talc and kaoline, were deposited therein. Moreover, no toner was deposited inside the foreign-matter collecting container 13. Furthermore, none of black spots, black lines and other stains were found on the sheets of copy paper 9; this ensured that it is possible to obtain transferred images with good picture quality for a long time.

As described above, in the electrophotographic printing machine of the present embodiment also, it is possible to obtain the same functions and effects as those obtained in the electrophotographic printing machine of the aforementioned Embodiment 2 (that is, Embodiment 1). Further, in the electrophotographic printing machine of the present embodiment, the foreign-matter removing roller 21 has a synthetic-resin layer 21*c* that functions as dielectric material and that comes into contact with the surface of the photoconductor drum 1. In this arrangement, the surface portion of the foreign-matter removing roller 21, which comes into contact with the surface of the photoconductor drum 1, is made of a dielectric material; this makes it possible to prevent the surface of the photoconductor drum 1 from being subjected to an injection of charge from the foreign-matter removing roller 21. Thus, it becomes possible to maintain the difference between the surface electric potential of the photoconductor drum 1 and the surface electric potential of the foreign-matter removing roller 21 at a virtually constant value. Therefore, the electric field that is exerted between the surface of the photoconductor drum 1 and the surface of the foreign-matter removing roller 21 is stabilized, and this ensures an effective foreign-matter removing operation that is carried out on the surface of the photoconductor drum 1.

[EMBODIMENT 4]

Figure 9:
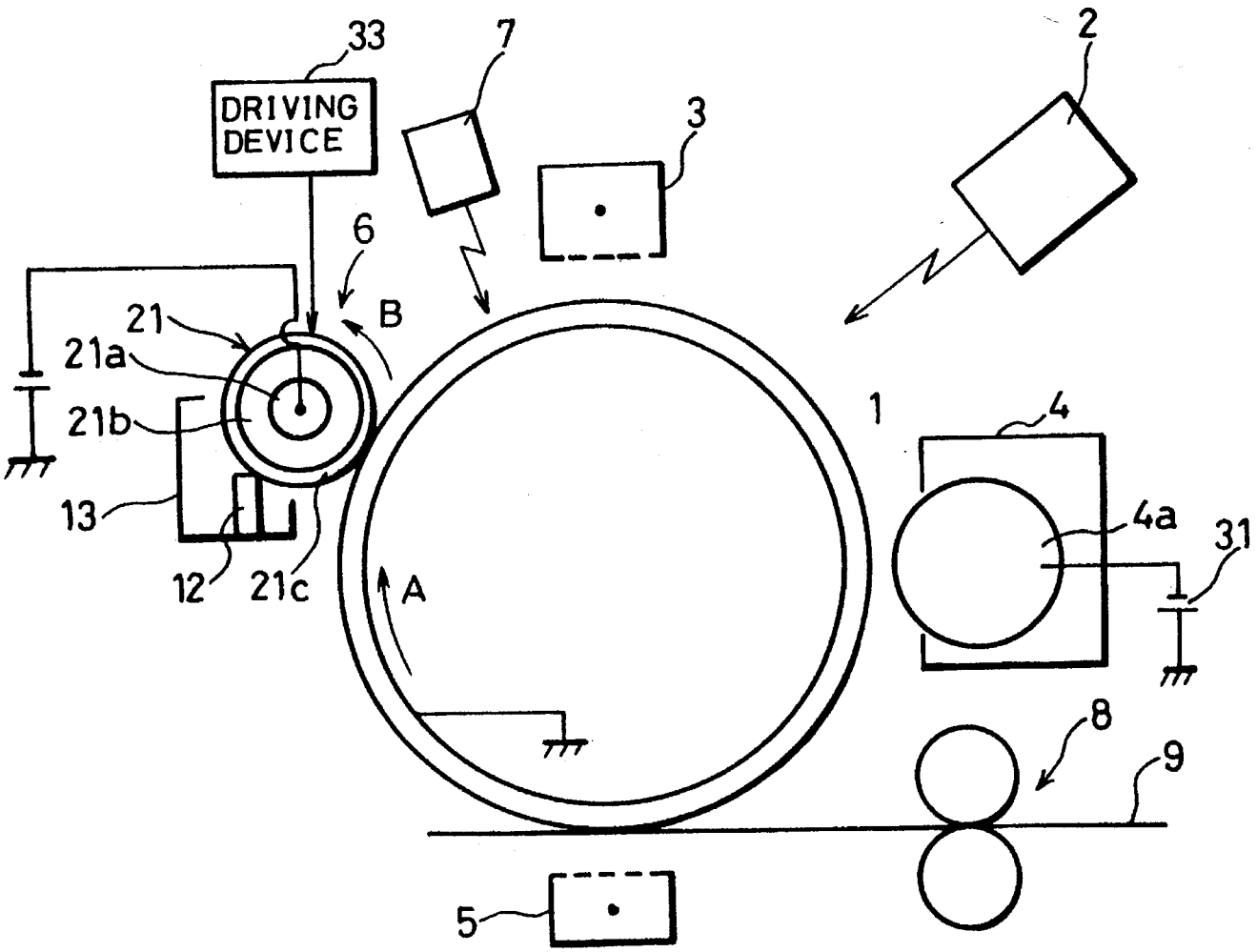
FIG. 9 is a schematic side view of an electrophotographic printing machine that is an example of an image-forming apparatus in still another embodiment of the present invention.

Referring to FIG. 9, the following description will discuss still another embodiment of the present invention. Here, for convenience of explanation, those members that have the same functions and that are described in Embodiment 3 with reference to its drawings are indicated by the same reference numerals and the description thereof is omitted.

The foreign-matter removing roller 21 of the cleaning device 6, which is installed in the electrophotographic printing machine of the present embodiment, is allowed to rotate in the direction of arrow B by a driving device 33, while kept in contact with the photoconductor drum 1. Moreover, the shaft 21*a* of the foreign-matter removing roller 21 is connected to ground. In other words, the cleaning device 6 is not provided with the electric potential-applying member 14 (see FIG. 7). The other arrangements of the electrophotographic printing machine are the same as those of the electrophotographic printing machine of the aforementioned Embodiment 3.

Referring to experimental examples, an explanation will be given below on the removing operation of the cleaning device 6 in the electrophotographic printing machine having the above-mentioned arrangement. Here, in the following experimental examples, an organic photoconductor drum, which has a diameter of 30 mm and whose charge carrier transport layer is made of polycarbonate, was used as the photoconductor drum 1. Moreover, a roller, which has a synthetic-resin layer 21*b* of conductive silicone resin (2 mm in thickness) having a resistance of virtually $10^8$ Ω and a synthetic-resin layer 21*c* of fluororesin (50 μm in thickness) having a resistance of not less than $10^{11}$ Ω, was used as the foreign-matter removing roller 21 in the cleaning device 6. Furthermore, the foreign-matter removing roller 21 was rotated by a driving device 33 so that its surface speed becomes about 75 mm/sec. This speed is equivalent to 1.5 times the surface speed of the photoconductor drum 1 that is driven to rotate in the direction of arrow A. Therefore, the foreign-matter removing roller 21, that is, the synthetic-resin layer 21*c* functioning as dielectric material, was negatively charged by static electricity generated by friction against the photoconductor drum 1 functioning as a friction member. Here, the surface of the photoconductor drum 1 was positively charged.

Then, transferring operations that are the same as those in the electrophotographic printing machine of the aforementioned Embodiment 3 were carried out. After completion of these transferring operations, an examination was made on materials stored inside the foreign-matter collecting container 13 of the cleaning device 6, and it was found that white matters, which were certainly recognized as foreign matters such as paper powder, talc and kaoline, were deposited therein. Moreover, no toner was deposited inside the foreign-matter collecting container 13. Furthermore, none of black spots, black lines and other stains were found on the sheets of copy paper 9; this ensured that it is possible to obtain transferred images with good picture quality for a long time.

As described above, in the electrophotographic printing machine of the present embodiment also, it is possible to obtain the same functions and effects as those obtained in the electrophotographic printing machine of the aforementioned Embodiment 3. In other words, the electrophotographic printing machine of the present embodiment is provided with a foreign-matter removing roller 21 which is charged by static electricity generated by friction against the photoconductor drum 1 that functions as a friction member. The surface of the foreign-matter removing roller 21 is charged to such a electric potential that foreign matters, which is charged to have the transferring polarity due to the electric field that is exerted between the surface of the photoconductor drum 1 and the foreign-matter removing roller 21, are allowed to adhere to the foreign-matter removing roller 21. More specifically, through the friction against the surface of the photoconductor drum 1, the surface of the foreign-matter removing roller 21 is charged to have a electric potential that is biased toward the polarity of the charged toner (toward the polarity reversed to the transferring polarity), that is, the surface electric potential of the foreign-matter removing roller 21 is biased further toward the polarity of the charged toner than the surface electric potential of the photoconductor drum 1, at the contact portion between the photoconductor drum 1 and the foreign-matter removing roller 21.

Thus, in the foreign-matter removing roller 21, it is possible to separate foreign matters adhering to the surface of the photoconductor drum 1 from the surface of the photoconductor drum 1 and to allow them to adhere to the foreign-matter removing roller 21. Moreover, the charged electric potential of toner remaining on the surface of the photoconductor drum 1 has a polarity reversed to that of the foreign matters; this makes it possible to prevent the toner from adhering to the foreign-matter removing roller 21.

Therefore, it becomes possible to selectively remove only the foreign matters out of the toner and the foreign matters that remain on the surface of the photoconductor drum 1 sufficiently. This makes it possible to provide an electrophotographic printing machine, that is, an image forming apparatus, which is capable of supplying images with good picture quality for a long time.

Further, when the developing device 4 is modified to have a residual-toner collecting function as described earlier, a waste-toner collecting container, which has been used in conventional electrophotographic printing machines, is no longer required; this makes the machine compacter. Moreover, it becomes possible to reduce the consumption of toner, compared to the conventional machines.

[EMBODIMENT 5]

Figure 10:
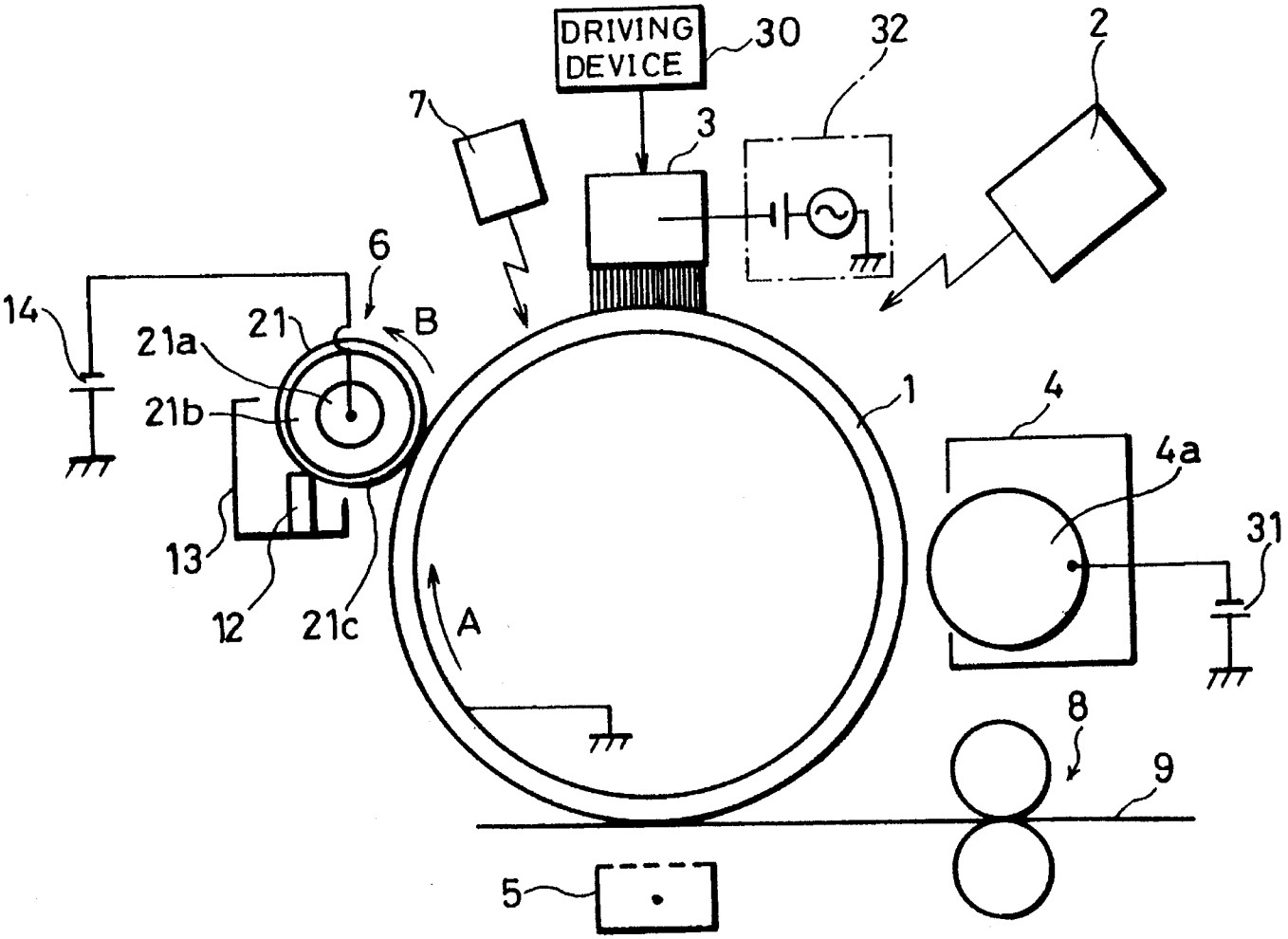
FIG. 10 is a schematic side view of an electrophotographic printing machine that is an example of an image-forming apparatus in still another of the present invention.

Referring to FIG. 10, the following description will discuss still another embodiment of the present invention. Here, for convenience of explanation, those members that have the same functions and that are described in Embodiment 3 with reference to its drawings are indicated by the same reference numerals and the description thereof is omitted.

In the electrophotographic printing machine of the present embodiment, the main charger 3 is designed as a brush charger that was described in detail in Embodiment 1, instead of the charger made of scorotron. The other arrangements of the electrophotographic printing machine are the same as those of the electrophotographic printing machine of the aforementioned Embodiment 3.

Referring to experimental examples, an explanation will be given below on the removing operation of the cleaning device 6 in the electrophotographic printing machine having the above-mentioned arrangement. Here, in the following experimental examples, an oscillating voltage, which is formed by superimposing an ac voltage (a peak-to-peak voltage of 700 V with a frequency of 60 Hz) on a dc voltage of −600 V, is applied to the main charger 3 from the charging power source 32. Moreover, the main charger 3 was reciprocally oscillated by a driving device 30 at an oscillation frequency of 7 Hz with a stroke of 10 mm in the axial direction of the photoconductor drum 1 with the semiconductive fibers 3*b* kept in contact with the surface of the photoconductor drum 1. Here, a document of A4 size having its entire surface printed, that is, a solid document, is used as an original document.

In this electrophotographic printing machine, transferring operations that are the same as the transferring operations in the electrophotographic printing machine of Embodiment 3 were carried out, and these transferring operations were repeated until the number of the transferring operations reached virtually 20000 times (that is, until 20000 copies were made).

After completion of the transferring operations, the same transferring operations were successively carried out by using an original document of A4 size with a printed portion of 4% of its entire surface. As a result, neither black spots nor black lines or other stains were found on the sheets of copy paper 9, and copied images with good picture quality were obtained. Moreover, an examination was made on materials stored inside the foreign-matter collecting container 13 of the cleaning device 6, and it was found that white matters, which were certainly recognized as foreign matters such as paper powder, talc and kaoline, were deposited therein. No toner was deposited inside the foreign-matter collecting container 13.

Here, the semiconductive fibers 3*b* of the main charger 3 had toner adhering thereon, but the amount of the adhering toner was much smaller than the amount of residual toner that was deposited in the case when the solid original document of A4 size were copied 20000 times. This shows that the residual toner remaining on the surface of the photoconductor drum 1 is collected into the developing device 4 through the above-mentioned collecting operation.

As described above, in the electrophotographic printing machine of the present embodiment also, it is possible to obtain the same functions and effects as those obtained by the electrophotographic printing machine of the aforementioned Embodiment 3.

Additionally, in order to make a comparison with the electrophotographic printing machine of the present embodiment, the same transferring operations as those in the electrophotographic printing machine of the present embodiment were carried out on a comparative-use electrophotographic printing machine which has no cleaning device 6. More specifically, after a solid original document of A4 size had been copied 100 times, the same transferring operations were carried out by using an original document of A4 size with a printed portion of 4% of its entire surface. As a result, it was found that black spots and black lines appeared on the sheets of copy paper 9, and it was not possible to obtain copied images with good picture quality.

Further, in order to make a comparison with the electrophotographic printing machine of the present embodiment, the same transferring operations as those in the electrophotographic printing machine of the present embodiment were carried out on a comparative-use electrophotographic printing machine in which a dc voltage of −1050 V, that is, a voltage that exceeds two times the break-down voltage, is applied to the main charger 3. More specifically, after a solid original document of A4 size had been copied 50 times, the same transferring operations were successively carried out by using an original document of A4 size with a printed portion of 4% of its entire surface. As a result, it was found that black spots and black lines as well as white spots and white lines appeared on the sheets of copy paper 9, and it was not possible to obtain copied images with good picture quality.

[EMBODIMENT 6]

Figure 11:
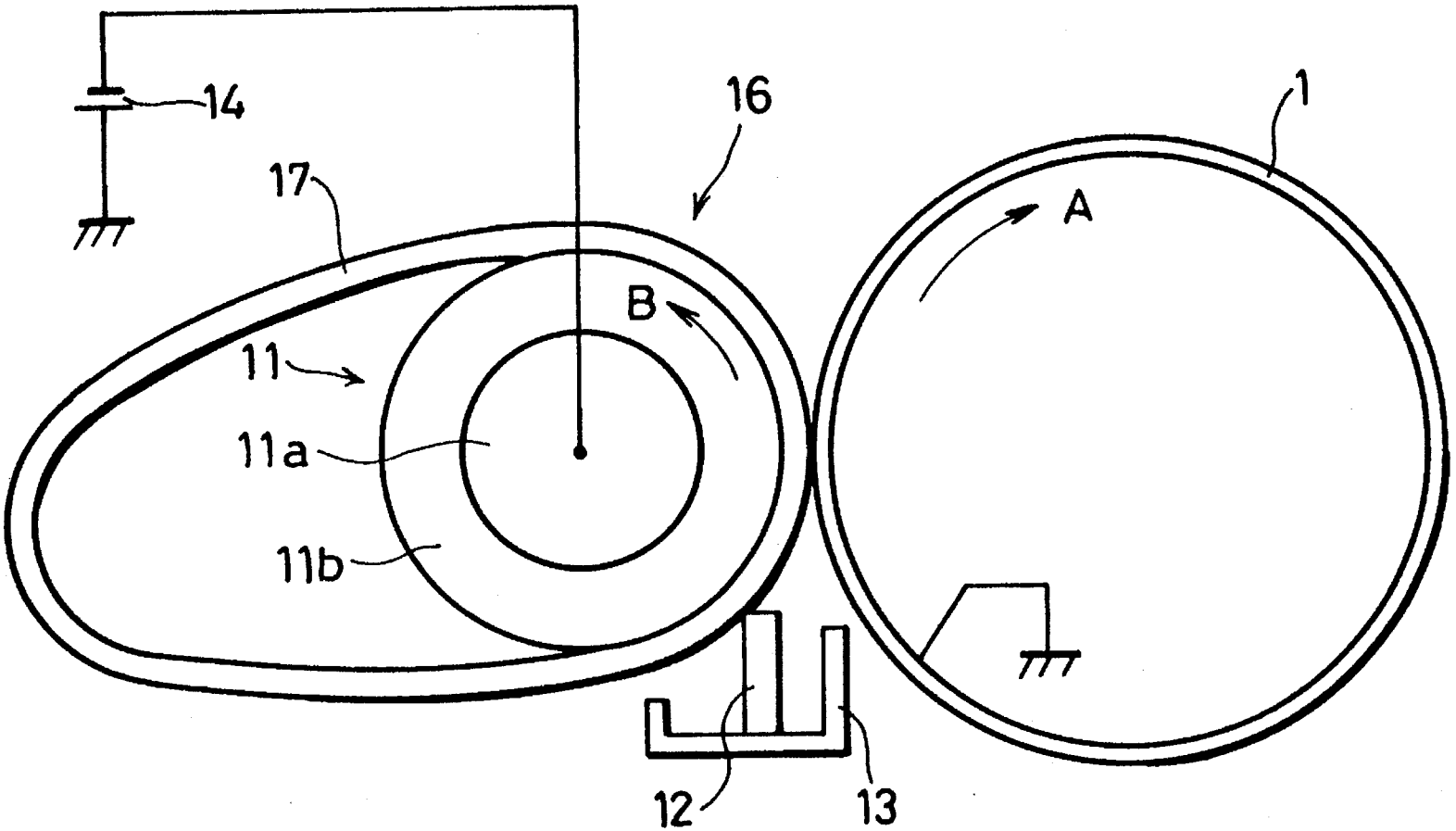
FIG. 11 is a schematic side view showing an essential part of an electrophotographic printing machine that is an example of an image-forming apparatus in the other embodiment of the present invention.

Referring to FIG. 11, the following description will discuss still another embodiment of the present invention. Here, for convenience of explanation, those members that have the same functions and that are described in Embodiment 3 with reference to its drawings are indicated by the same reference numerals and the description thereof is omitted.

The electrophotographic printing machine of the present embodiment is provided with a cleaning device 16, shown in FIG. 11, instead of the cleaning device 6 of the aforementioned Embodiment 3. The cleaning device 16 is constituted of a foreign-matter removing roller 11, a scraping member 12, a foreign-matter collecting container 13, a electric potential-applying member 14 (see FIG. 1), and a dielectric film 17. The scraping member 12 scrapes foreign matters adhering to the surface of the film 17 therefrom so as to always maintain the surface of the film 17 clean. The foreign-matter removing roller 11, which has the same construction as that shown in FIG. 3, is provided with a shaft 11*a* made of metal and a synthetic resin layer 11*b* having a semiconductive property. To the shaft 11*a* of the foreign-matter removing roller 11, is applied by the electric potential-applying member 14 a electric potential whose polarity is reversed to that of the voltage applied to the transferring device 5.

The film 17 has an appropriate elasticity (flexibility) and surface smoothness, and is formed into an endless belt that has a diameter greater than the diameter of the foreign-matter removing roller 11. Moreover, the width of the film 17, that is, the length in the axial direction of the photoconductor drum 1, is set to be slightly longer than the length of the photoconductor drum 1. The foreign-matter removing roller 11 is installed inside the film 17. Therefore, the film 17 is installed with its portion sandwiched between the foreign-matter removing roller 11 and the photoconductor drum 1. Furthermore, the film 17 is allowed to rotate (so-called passive rotation) in the direction of arrow B, following the rotation of the photoconductor drum 1 in the direction of arrow A. The film 17 allows foreign matters to adhere to its surface. Here, the diameter of the film 17 is not specifically limited, as long as it is greater than the diameter of the foreign-matter removing roller 11. In other words, the diameter of the film 17 is set to any size, as long as it allows the foreign-matter removing roller 11 to be installed inside thereof.

More specifically, for example, the following materials are listed for use as the film 17: fluororesins, such as polyvinylidene fluoride, polytetrafluoroethylene and ether copolymer of tetrafluoroethylene-perfluoroalkylvinyl, urethane resins, silicone resins, and other materials. Further, as for the so-called dielectric capacity of the film 17, it is preferable to have a greater value thereof; thus, the relative dielectric constant of the film 17 is preferably set to a greater value. The relative dielectric constant of polyvinylidene fluoride is approximately 8, and the relative dielectric constants of the other synthetic resins as described above are approximately in the range of 2 to 3. Moreover, as for the thickness of the film 17, it is preferable to make it thinner, and for example, it is preferably set to not more than 50 μm. The other arrangements of the electrophotographic printing machine is the same as those of the electrophotographic printing machine of Embodiment 3.

With this arrangement wherein the film 17, which has an appropriate elasticity (flexibility) and surface smoothness, is sandwiched between the foreign-matter removing roller 11 and the photoconductor drum 1, it becomes possible to widen the contact area (so-called nip width) between the photoconductor drum 1 and the film 17, compared to the case where the foreign-matter removing roller 11 is allowed to directly contact the photoconductor drum 1. This ensures that foreign matters are removed from the surface of the photoconductor drum 1. Moreover, since the contact area is widened, it is possible to set the voltage to be applied to the shaft 11*a* of the foreign-matter removing roller 11 to be a value lower than the applying voltage in the case when the foreign-matter removing roller 11 is allowed to directly contact the photoconductor drum 1.

Referring to experimental examples, an explanation will be given below on the removing operation of the cleaning device 6 in the electrophotographic printing machine having the above-mentioned arrangement. Here, in the following experimental examples, an organic photoconductor drum 1 having a diameter of 30 mm is used as the photoconductor drum 1. Further, a roller, which has a synthetic resin layer 11*b* of conductive silicone resin (2 mm in thickness) having a resistance of not more than $10^3$ Ω, is used as the foreign-matter removing roller 11 in the cleaning device 6. The shaft 11a is charged to −300 V by the electric potential-applying member 14. Moreover, the film 17 is made up of polyvinylidene fluoride (20 μm in thickness) which has a resistance of not less than $10^{12}$ Ω and a relative dielectric constant of approximately 8.

In this electrophotographic printing machine, transferring operations that are the same as the transferring operations in the electrophotographic printing machine of Embodiment 3 were carried out. After completion of these transferring operations, an examination was made on materials stored inside the foreign-matter collecting container 13 of the cleaning device 16, and it was found that white matters, which were certainly recognized as foreign matters such as paper powder, talc and kaoline, were deposited therein. Moreover, no toner was deposited inside the foreign-matter collecting container 13. Furthermore, none of black spots, black lines and other stains were found on the sheets of copy paper 9; this ensured that it is possible to obtain copied images with good picture quality for a long time.

As described above, in the electrophotographic printing machine of the present embodiment also, it is possible to obtain the same functions and effects as those obtained in the electrophotographic printing machine of the aforementioned Embodiment 3. Further, the electrophotographic printing machine of the present embodiment is provided with a film 17 that functions as a dielectric material and that contacts the surface of the photoconductor drum 1. For this reason, the foreign-matter removing roller 11, that is, the film 17, is charged more uniformly in its entire surface. This ensures that foreign matters are removed from the surface of the photoconductor drum 1 more completely.

Additionally, in the present embodiment, the film 17 and the foreign-matter removing roller 11 are provided as separated parts; however, for example, another arrangement may be adopted wherein the film 17 is laid over the surface of the synthetic resin layer 11*b* of the foreign-matter removing roller 11.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image-forming apparatus, which forms images by using an electrostatic photographic method, comprising:

an image-bearing device for bearing a developer image on its surface;

electrostatic-latent-image forming means for forming an electrostatic latent image on the surface of the image-bearing device;

developing means for developing the electrostatic latent image formed on the surface of the image-bearing device by using developer that has been charged to have a predetermined polarity;

transferring means for transferring the developer image electrostatically from the image-bearing device onto a transferring member by applying a charge with a polarity reversed to that of the charged electric potential of the developer onto the transferring member that is tightly in contact with the surface of the image-bearing device having the developer image formed thereon; and cleaning means for selectively removing foreign matters other than developer that remain on the surface of the image-bearing device after the transferring process, wherein the cleaning means includes:

a cleaning member that is in contact with the surface of the image-bearing device and that allows foreign matters, which have been charged to have a polarity reversed to that of the charged electric potential of the developer by the charge applied by the transferring means, to adhere to the surface thereof by using an electric field that has been formed between the image-bearing device and the cleaning member, at least a surface of the cleaning member being made of a dielectric material or a semiconductive material;

and electric potential-applying means for applying an electric potential to the cleaning member so that the surface of the cleaning member is charged to have an electric potential that is biased further toward a polarity reversed to that of a potential to be applied from said transfer means than the surface electric potential of the image-bearing device at the contact portion between the cleaning member and the image-bearing device.

2. The image-forming apparatus as defined in claim 1, wherein the cleaning member is a cleaning roller that is made up of a conductive shaft member and a semiconductive surface member that covers the periphery of the shaft member and the electric potential-applying means is a cleaning-bias applying means for applying a predetermined dc voltage to the shaft member.

3. The image-forming apparatus as defined in claim 1, wherein the cleaning member is a cleaning roller that is made up of a conductive roller member and a dielectric that covers the periphery of the roller member and the electric potential-applying means is a cleaning-bias applying means for applying a predetermined dc voltage to the roller member.

4. The image-forming apparatus as defined in claim 3, wherein the roller member is made up of a metal shaft and conductive synthetic resin that covers the periphery of the metal shaft.

5. The image-forming apparatus as defined in claim 1, wherein the cleaning member has a surface made of a dielectric and the electric potential-applying means is a friction charging member for charging the surface of the cleaning member through friction while contacting the surface of the cleaning member.

6. The image-forming apparatus as defined in claim 1, wherein the cleaning means further comprises a foreign-matter removing means for removing foreign matters that adhere to the surface of the cleaning member.

7. The image-forming apparatus as defined in claim 6, wherein the foreign-matter removing means is a scraping member that contacts the surface of the cleaning member and that scrapes foreign matters adhering to the surface of the cleaning member therefrom.

8. The image-forming apparatus as defined in claim 1, wherein the cleaning member includes a dielectric that comes into contact with the surface of the image-bearing device.

9. The image-forming apparatus as defined in claim 8, wherein: the cleaning member includes a conductive pressing roller for pressing the dielectric onto the surface of the image-bearing device, the dielectric being a flexible film having an endless-belt shape that is passed around the periphery of the pressing roller; and the electric potential-applying means is a cleaning-bias applying means for applying a predetermined dc voltage to the pressing roller.

10. The image-forming apparatus as defined in claim 1, wherein the developing means includes developer-collecting means for collecting developer that remains on the surface of the image-bearing device after a transferring operation.

11. The image-forming apparatus as defined in claim 10, wherein the developing means includes:

a developing roller for supplying developer that has been charged to have the same polarity as that of the electric potential at the electrostatic latent image portion on the surface of the image-bearing device to the non-electrostatic latent image portion; and developing-bias applying means for applying a developing bias voltage to the developing roller so that the developing roller has a electric potential that is located between the electric potential of the electrostatic latent image portion and the electric potential of the non-electrostatic latent image portion, and so that the developer, which remains on the image-bearing device, is allowed to move to the developing roller through an electric field that is formed between the image-bearing device and the developing roller.

12. The image-forming apparatus as defined in claim 1, wherein the image-bearing device is a photoconductor and the electrostatic-latent-image forming means includes exposure means for exposing the surface of the image-bearing device and charging means for charging the surface of the image-bearing device uniformly prior to exposure that is carried out by the exposure means, the charging means being a contact charger for charging the surface of the image-bearing device by directly applying a voltage to the surface of the image-bearing device while contacting the surface of the image-bearing device.

13. The image-forming apparatus as defined in claim 12, wherein the contact charger is a brush charger for charging the surface of the image-bearing device by making the top of the brush thereof contact with the surface of the image-bearing device.

14. The image-forming apparatus as defined in claim 13, wherein the contact charger is a belt-like brush charger that has brush hairs planted on a belt-shaped conductive plate.

15. The image-forming apparatus as defined in claim 13, wherein the contact charger is a roller-shaped brush charger that has brush hairs planted around a conductive roller.

16. The image-forming apparatus as defined in claim 14, further comprising driving means for reciprocally oscillating the belt-like brush charger at predetermined stroke and oscillation frequency with the top of the brush kept in contact with the surface of the image-bearing device.

17. The image-forming apparatus as defined in claim 14, wherein the image-bearing device is a photoconductor drum and the driving means reciprocally oscillates the belt-like brush charger in the axial direction of the photoconductor drum.

18. The image-forming apparatus as defined in claim 12, wherein the contact charger includes a contact member that contacts the surface of the image-bearing device and dc-voltage applying means for applying a dc voltage to the contact member.

19. The image-forming apparatus as defined in claim 12, wherein the contact charger includes a contact member that contacts the surface of the image-bearing device and oscillating-voltage applying means for applying an oscillating voltage which is adc voltage on which an ac voltage is superimposed.

20. The image-forming apparatus as defined in claim 19, wherein the oscillating voltage, which is applied to the contact member by the oscillating-voltage applying means, has a peak-to-peak voltage that is set to not more than two times of a break-down voltage that is a voltage at which a charge is initiated between the surface of the image-bearing device and the contact charger.

21. An image-forming apparatus, which forms images by using an electrostatic photographic method, comprising:

an image-bearing device for bearing a developer image on its surface;

electrostatic-latent-image forming means for forming an electrostatic latent image on the surface of the image-bearing device;

developing means for developing the electrostatic latent image formed on the surface of the image-bearing device by using developer that has been charged to have a predetermined polarity;

transferring means for transferring the developer image from the image-bearing device onto a transferring member by applying a charge with a polarity reversed to that of the charged electric potential of the developer onto the transferring member that is tightly in contact with the surface of the image-bearing device having the developer image formed thereon; and cleaning means for selectively removing foreign matters other than developer that remain on the surface of the image-bearing device after the transferring process;

wherein the cleaning means includes:

a cleaning member that is in contact with the surface of the image-bearing device and that allows foreign matters, which have been charged by the transferring means to have a polarity reversed to that of the charged electric potential of the developer, to adhere to the surface thereof by using an electric field that has been formed between the image-bearing device and the cleaning member, the cleaning member being charged through friction against the surface of the image-bearing device so that the surface electric potential of the cleaning member is biased further toward the polarity of the charged toner than the surface electric potential of the image-bearing device at the contact portion between the cleaning member and the image-bearing device.

22. The image-forming apparatus as defined in claim 21, wherein the cleaning member is a cleaning roller that is made up of a dielectric at least in the surface portion thereof.

23. The image-forming apparatus as defined in claim 22, wherein the cleaning means includes driving means for rotating the cleaning roller so that the peripheral velocity of the cleaning roller is varied from the travelling speed of the surface of the image-bearing device.

24. The image-forming apparatus as defined in claim 21, wherein the developing means includes developer-collecting means for collecting developer remaining on the surface of the image-bearing device after the transferring operation.

* * * * *